US006334532B1

(12) United States Patent
Tambo et al.

(10) Patent No.: US 6,334,532 B1
(45) **Date of Patent: *Jan. 1, 2002**

(54) HINGED-LID PACK

(75) Inventors: Hitoshi Tambo; Toru Iwano, both of Tokyo (JP)

(73) Assignee: Japan Tobacco Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/123,580

(22) Filed: Jul. 28, 1998

(30) Foreign Application Priority Data

Jul. 28, 1997 (JP) ..... 9-201934
Jul. 28, 1997 (JP) ..... 9-201936

(51) Int. Cl.[7] ..... B65D 85/10; B65D 43/16

(52) U.S. Cl. ..... 206/268; 206/273; 229/148; 229/160.1

(58) Field of Search ..... 206/268, 270, 206/271, 273, 266; 229/146, 149, 160.1, 148

(56) References Cited

U.S. PATENT DOCUMENTS 3,326,447 A * 6/1967 Williamson ..... 229/146
3,828,923 A * 8/1974 Phillips, Jr. ..... 206/273
4,428,525 A * 1/1984 Brauner ..... 229/146
4,753,384 A * 6/1988 Focke et al. ..... 206/273
4,948,038 A 8/1990 Moeller
5,129,513 A * 7/1992 David et al. ..... 206/271
5,443,202 A * 8/1995 Jorgensen-Beck et al. ..... 229/160.1

FOREIGN PATENT DOCUMENTS

| | | |
|---|---|---|
| DE | 29618848 U | 3/1998 |
| EP | 0841263 | 5/1998 |
| FR | 2293368 | 7/1976 |
| JP | A2-296641 | 12/1990 |
| WO | 98/18683 A | 5/1998 |

* cited by examiner

*Primary Examiner*—Luan K. Bui
(74) *Attorney, Agent, or Firm*—Birch, Stewart, Kolasch & Birch, LLP

(57) ABSTRACT

A hinged-lid pack for filter cigarettes comprises a box-shaped body and a box-shaped lid. When the lid is shut down, an inner frame that forms a part of the body is covered by the lid. The inner frame includes a raised lug, and an inner front flap of the lid includes an engaging portion that engages the lug. When the lid is on, the engaging portion adjoins the distal end of the lug. When the lid in this state is rocked slightly in the opening direction, the distal end of the lug is held between the engaging portion and the inner surface of the lid.

10 Claims, 20 Drawing Sheets

HINGED-LID PACK

BACKGROUND OF THE INVENTION

1. Field of the Invention

The present invention relates to a hinged-lid pack adapted for the packaging of cigarettes or filter cigarettes.

2. Description of the Related Art

Hinged-lid packs of this type are disclosed in Jpn. Pat. Appln. KOKAI Publication No. 2-296641, for example. These conventional hinged-lid packs comprise a box-shaped body, which is open-topped. A box-shaped lid is connected to a rear opening edge of the body. The lid can be put on and removed from the open end of the body by being rocked around a self-hinge means. Thus, the lid can open and close the opening of the body.

The body has a shoulder on its front side, and the shoulder extends along the opening edge of the body. On the other hand, the lid has a flap on its front opening edge, and the flap is turned in toward the inside of the lid.

According to the hinged-lid packs described above, when the lid is put on the open end portion of the body to close the body opening, the flap of the lid is further turned in to get over the shoulder, and its distal end edge is butted against the lower end edge of the shoulder. Thus, if the lid is urged thereafter to be lifted with a relatively small force, it cannot be lifted unexpectedly, since the lid flap and the body shoulder are anchored to each other.

When the flap gets over the shoulder, it springs back to hit the front face of the body, thereby producing a click. Hearing this click, a user is expected to confirm that the lid is fully shut down and guess the freshness of the contents of the hinged-lid packs.

In the cases of the conventional hinged-lid packs described above, the distal end of the flap is kept anchored to the lower end edge of the shoulder when the lid is actually lifted, so that the flap is turned back substantially. If the open-close operation of the lid is repeated only several times, therefore, the elastic force of the basal part of the flap lowers suddenly. Thus, if the lid is shut down thereafter, the rebounding force of the flap is too feeble to produce a distinct click.

If the elastic force of the flap is reduced, the flap is left turned back and extending outside the lid. In this case, the user must deliberately tuck the flap inside the lid before shutting the lid down.

Besides this, if the flap and the shoulder fail to be disengaged satisfactorily from each other when the lid of the conventional hinged-lid packs is lifted, they are damaged inevitably as the lid is lifted forcibly. In this situation, the flap and the shoulder cannot then engage each other, so that there is the possibility of the lid being lifted unexpectedly.

In the cases of hinged-lid packs shown in FIGS. 7, 8 and 9 of the aforementioned publication, their shoulder opening portion is formed by providing the front face of their outer frame with a wide opening in a lap region between the outer frame and their inner frame so that the front face of the inner frame is exposed through the opening. With this opening in the outer frame, air flows into and out of the body of the pack through the shoulder opening portion, so that the gas barrier properties of the pack are ruined. Thus, the hinged-lid packs of this type cannot fulfill requirements for the maintenance of the freshness of cigarettes, an object of the present invention.

In a hinged-lid pack shown in FIG. 11 of the same publication. the front face of its inner frame is provided with a depressed portion. When the pack is loaded with cigarettes, however, the depressed portion cannot ensure a necessary depression for a flap of a lid, so that the lid cannot be anchored securely.

SUMMARY OF THE INVENTION

The object of the present invention is to provide a hinged-lid pack, in which a lid can be prevented from being lifted unexpectedly and can be lifted with ease when expected, the lockability of the lid can be securely maintained for a long period although the open-close operation of the lid is repeated, clicks can be produced when the lid is lifted and shut down, the clicking capability can be maintained for a long period, and the quality of cigarettes therein can be maintained satisfactorily.

The above object is achieved by a hinged-lid pack according to the present invention, which comprises a box-shaped body opening at the top end thereof, a box-shaped lid hingedly connected to a rear opening edge of the body, and locking means including a lug provided in an upper region of a front wall of the body and an engaging portion in the lid. The lid includes a front wall adapted to close the opening of the body and cover the upper region of the front wall of the body from outside when the lid is in a shut state. The lug of the locking means extends obliquely downward from the front wall of the body. The engaging portion of the locking means adjoins the distal end of the lug when the lid is shut down, and allows the distal end of the lug to be inserted temporarily into the gap between the engaging portion and the front wall of the lid when the lid in the shut state and is rocked in the opening direction.

According to the hinged-lid pack of the invention, the distal end of the lug is inserted into the gap between the front wall of the lid and the engaging portion when the lid in the shut state is rocked in the opening direction. As this is done, the lug and the engaging portion are in engagement with each other. This engagement gives a predetermined resistance to the lifting operation of the lid and causes the lid to be locked to the body. Thus, the lid cannot be lifted unexpectedly.

When the lid is lifted against the aforesaid resistance, the engaging portion of the lid raises the lug, and the lug gets out soon from between the engaging portion and the front wall of the lid. Thus, the engaging portion and the lug are disengaged from each other, whereupon the lug relatively flips the engaging portion, thereby producing a click.

When the lid is shut down, thereafter, the engaging portion of the lid flattens and clears the lug of the body. When the engaging portion is disengaged from the distal end of the lug, in this case, the lug also springs back to hit the inner surface of the lid. thereby producing a click.

Since the lug is located in the upper region of the front wall of the body, the body need not be provided with any opening. Accordingly, there is no possibility of the gas barrier properties of the hinged-lid pack being ruined. In consequence, the pack can maintain the quality of cigarettes therein for a long period.

Since the lug extends obliquely downward from the front wall of the body, moreover, the lug can satisfactorily project forward from the front wall of the body by utilizing the elastic force of its basal part even when the body is loaded with a lot of cigarettes. Thus, the engagement between the lug and the engaging portion can be obtained securely.

The front wall of the lid includes an outer wall and an inner wall lapped on the inner surface of the outer wall. The inner wall is connected integrally to the outer wall, and is turned in with respect to the outer wall. The boundary between the outer and inner walls defines a front lower edge of the lid.

The inner wall has a notch in the central portion thereof, the notch defining the engaging portion in conjunction with the front lower edge of the lid. Since the engaging portion is situated near the front lower edge of the lid, it never substantially raises the lug when the lid is lifted. In consequence, the elastic force of the basal part of the lug can be maintained for a long period. Thus, even after the open-close operation of the lid is frequently repeated, the lug can securely produce distinct clicks.

The inner wall can be lapped on the whole area of the inner surface of the outer wall. In this case, the inner wall has an opening in the central portion thereof, the opening defining the engaging portion in conjunction with the front lower edge of the lid.

The opening of the inner wall is tapered toward the ceiling of the lid. Preferably, moreover, this opening has the shape of a polygon. More specifically, the opening has the shape of a pentagon formed by cutting off both base-angle portions of an isosceles triangle having a base extending along the engaging portion. In this case, the respective tips of cigarettes cannot be positively caught by the edge of the opening even when they are repeatedly rubbed by the inner surface of the front wall of the lid as the lid is lifted and shut down. Thus, the cigarette tips cannot be easily damaged, so that the quality of the cigarettes in the pack cannot be ruined.

The length of the base of the opening of the inner wall is longer than the minimum width of the lug and shorter than the maximum width of the lug. In this case, the lug cannot be fully inserted into the gap between the engaging portion and the lid when the lid is lifted. As the lid rocks, therefore, the lug can easily get out from between the engaging portion and the lid. Thus, the lug and the engaging portion can be smoothly disengaged from each other, so that there is no possibility of the basal part of the lug tearing.

The locking means further includes a push portion attached to the lid and capable of pushing a part of the lid inward. The push of the push portion prevents the distal end of the lug from being inserted into the gap between the engaging portion and the lid when the lid in the shut state is rocked in the opening direction. More specifically, the push portion includes a substantially U-shaped slit formed in the front wall of the lid and a push piece surrounded by the slit and capable of being pushed in separately from and relatively to the front wall. In this case, the lug is depressed by the push piece to be flush with the front wall of the body when the push piece is pushed inside the lid. When the lid is rocked in the opening direction in this state, the distal end of the lug cannot be inserted into the gap between the engaging portion and the lid. Thus, the lug and the engaging portion never engage each other, so that the lid can be lifted smoothly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the invention, and wherein.

DETAILED DESCRIPTION OF THE PREFERRED EMBODIMENTS

Figure 1:
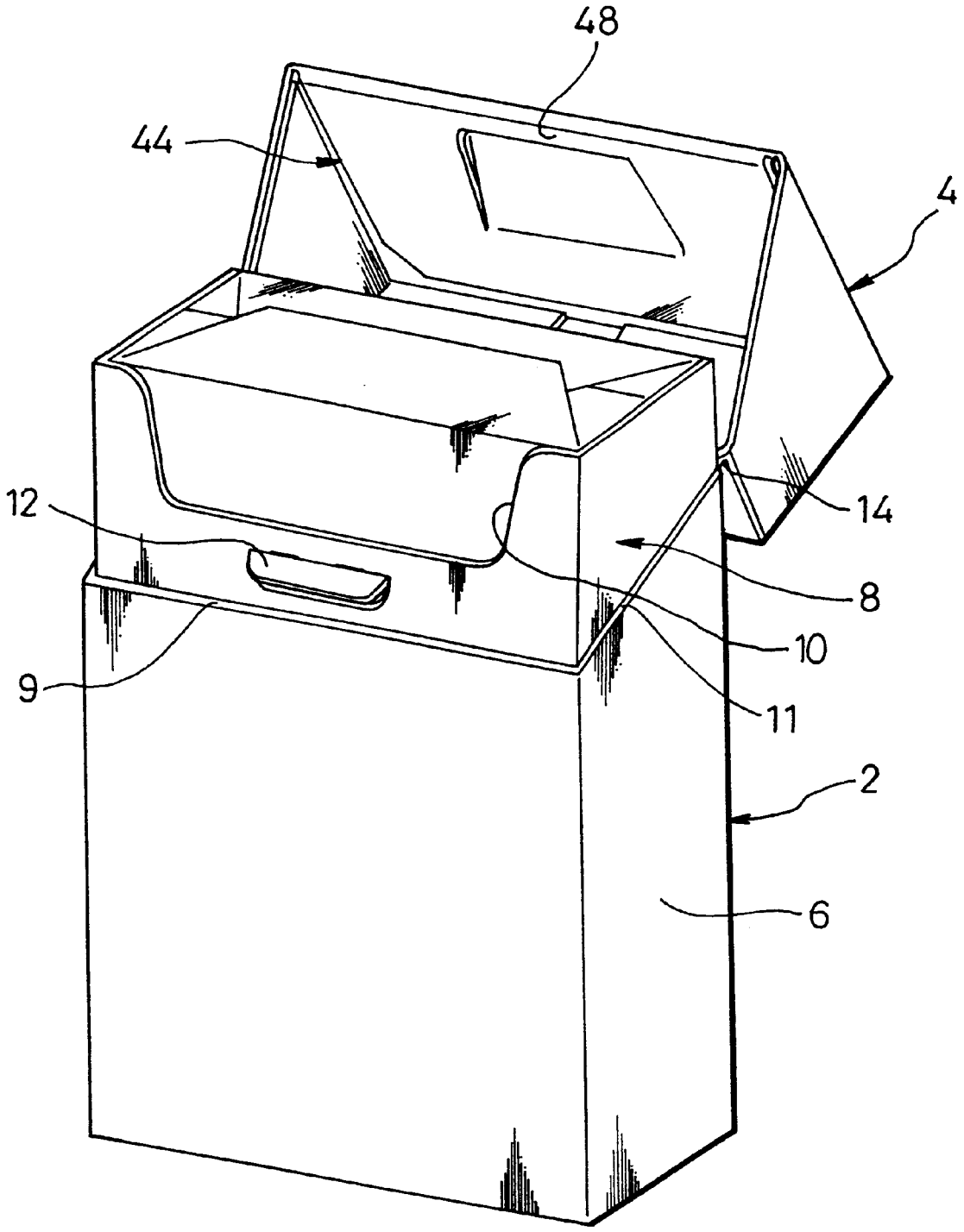
FIG. 1 is a perspective view showing a hinged-lid pack according to a first embodiment of the invention.

Referring to FIG. 1, there is shown a hinged-lid pack for filter cigarettes according to a first embodiment of the present invention. This hinged-lid pack, which comprises a body 2 and a box-shaped lid 4, can hold 20 cigarettes.

The body 2 is formed of a box-shaped outer frame 6 and a gutter-shaped inner frame 8. The outer frame 6 has is open-topped. More specifically, the top opening of the outer frame 6 is declined toward the front side. The inner frame 8 is partially inserted in the opening of the outer frame 6. The inner frame 8, which constitutes the upper end portion of the body 2, is bonded to the inner surface of the outer frame 6. The inner frame 8 extends from a front opening edge 9 and left- and right-hand side opening edges 11.

As seen from FIG. 1, a substantially U-shaped notch 10 is formed in the front face of the inner frame 8. The notch 10 makes the front of the inner frame 8 open wide, thereby facilitating the delivery of each cigarette from the body 2.

On the other hand, the lid 4, which is box-shaped, is connected integrally to the rear opening edge of the outer frame 6 by means of self-hinges 14. In this arrangement, the lid 4 can rock around the hinges 14. When the lid 4 is rocked from the state shown in FIG. 1 toward the upper end portion of the body 2, it overhangs the upper end portion of the body 2, that is, the inner frame 8, thereby closing the opening of the body 2. As this is done, the lid 4 comes intimately into contact with the front opening edge 9 and the side opening edges 11 of the outer frame 6. Thus, the lower end of the lid 4 is inclined to be in line with the open end of the outer frame 6.

The front face portion of the inner frame 8 forms a lap region that is overlapped by the front portion of the lid 4 when the lid 4 is shut down. The lap region is formed with a lug 12, which is raised from the inner frame 8 toward the upper end of the body 2.

Figure 2:
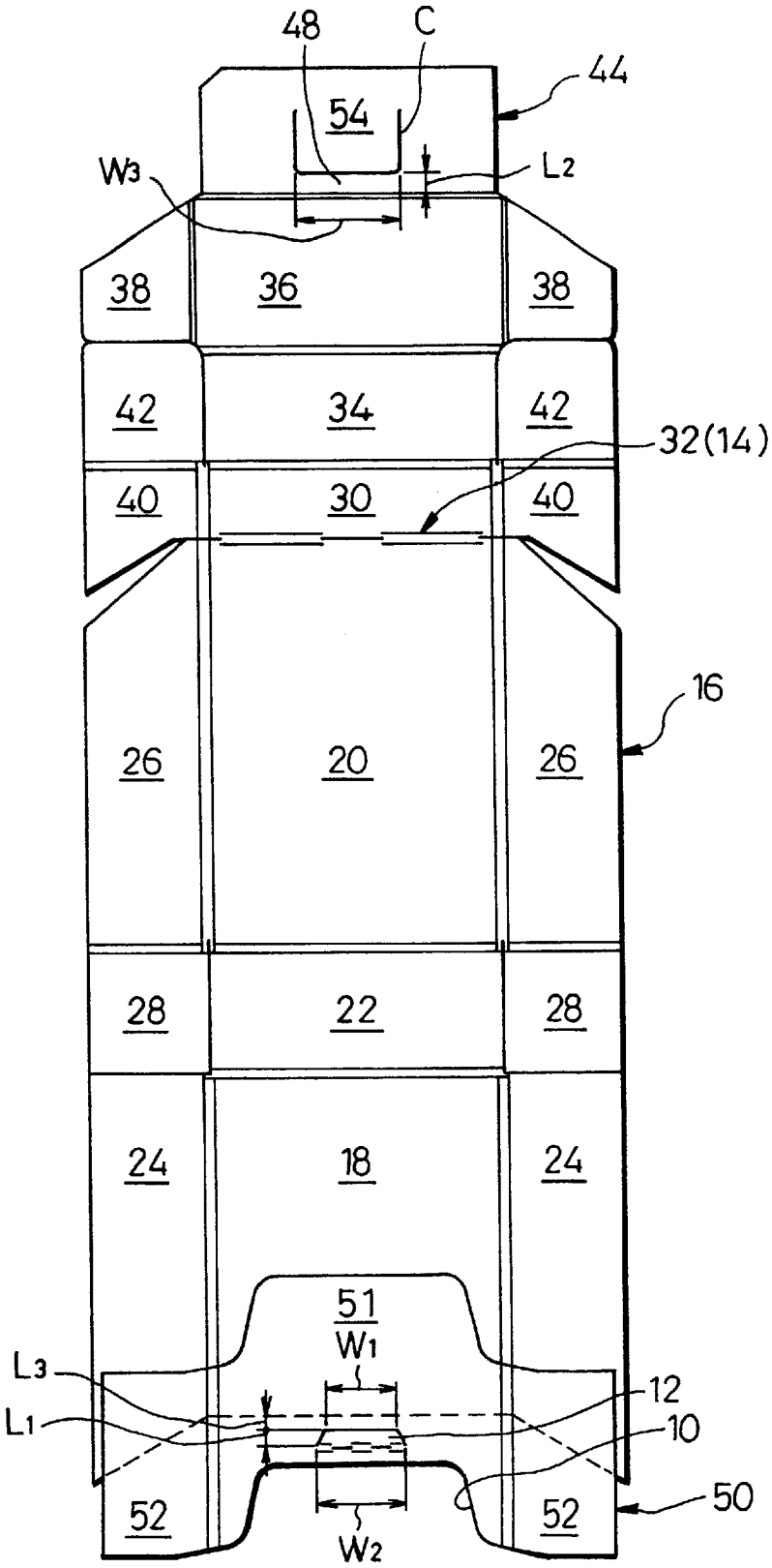
FIG. 2 is a view showing a blank from which the pack of FIG. 1 is formed.

The outer frame 6 and the lid 4 can be formed from one blank 16, which is shown in FIG. 2. The blank 16 has a large number of creases (double lines), which divide the blank 16 into a large number of zones. FIG. 2 shows the inner surface of the blank 16.

In FIG. 2, the blank 16 includes a front-face zone 18 and a rear-face zone 20, which serve as the front and rear faces, respectively, of the outer frame 6. The zones 18 and 20 are connected to each other by means of a bottom-face zone 22, which serves as the bottom face of the outer frame 6. Side zones 24 to serve as left- and right-hand side faces of the outer frame 6 are connected individually to the opposite sides of the front-face zone 18. Inner side flaps 26 are connected individually to the opposite sides of the rear-face zone 20. Inner bottom flaps 28 to be lapped on the bottom-face zone 22 are located individually between their corresponding side-face zones 24 and inner side flaps 26. The inner bottom flaps 28 are connected to the inner side flaps 26, individually.

A rear-face zone 30 to serve as the rear face of the lid 4 adjoins that side of the rear-face zone 20 opposite from the bottom-face zone 22. The rear-face zones 20 and 30 are connected to each other by means of hinge lines 32 that serve as the self-hinges 14, individually. A top-face zone 34 and a front-face zone 36, which serve as the top and front faces, respectively, of the lid 4, are connected successively to the rear-face zone 30. Side zones 38 to serve as left- and right-hand side faces of the lid 4 are connected individually to the opposite sides of the front-face zone 36. Inner side flaps 40 corresponding to the side-face zones 38 are connected individually to the opposite sides of the rear-face zone 30. Inner top flaps 42 for the top-face zone 34 are arranged between the side-face zones 38 and their corresponding inner side flaps 40. The inner top flaps 42 are connected to their corresponding inner side flaps 40, individually.

An inner front flap 44 for the front-face zone 36 is connected to that side of the front-face zone 36 opposite from the top-face zone 34. A substantially U-shaped slit C is cut in the central portion of the flap 44. An engaging portion 48 is secured between the base of the slit C and the front-face zone 36. The engaging portion 48 has a given length $L_2$ in the direction of the longitudinal axis of the blank 16.

The slit C thus cut in the inner front flap 44 defines a tongue portion 54 in the flap 44.

FIG. 2 also shows a blank 50 for the inner frame 8. The blank 50 is partially lapped on and bonded to the inner surface of the front-face zone 18 of the blank 16.

The blank 50 includes a central zone 51 and side flaps 52, which are connected individually to the opposite sides of the zone 51 by means of turn lines. The side flaps 52 serve as the side walls of the inner frame 8. The notch 10 and the lug 12 are formed in the zone 51. The lug 12 is formed by being raised from the zone 51.

As seen from FIG. 2, the lug 12 of the blank 50 and the engaging portion 48 of the inner front flap 44 are situated on the same line. A width $W_2$ of the basal part of the lug 12 is greater than a width W, of the distal end edge thereof. The width $W_2$ and a width $W_3$ of the engaging portion 48 are equal (e.g., about 16 mm).

A length $L_1$ of the lug 12 and a length $L_2$ of the engaging portion 48 (distance between the base of the slit C and the front-face zone 36) are also equal (e.g., about 3 mm).

Further, the a distance $L_3$ from the upper edge of the front-face zone 18 to the distal end of the lug 12 is longer than the length $L_2$ of the engaging portion 48. The upper edge of the front-face zone 18 defines an opening edge of the outer frame 6.

The blanks 16 and 50 are formed of a paper material, such as cardboard, manila paper, or aluminum-deposited paper. The weights and thicknesses of the blanks 16 and 50 range from 180 to 270 g/m$^2$ and from 0.2 to 0.5 mm, respectively.

The blanks 16 and 50 are turned in at turn lines in a specified order, whereby the body 2 and the lid 4 are formed. Twenty filter cigarettes are fed toward the blank 16 during this turning process. The moment the turning of the blanks 16 and 50 is finished, the hinged-lid pack is completed having its lid 4 on.

In the turning process for the hinged-lid pack, the lug 12 of the inner frame 8 is bent in the opposite direction compared with other zones or flaps. As shown in FIG. 2, the lug 12 is raised from the frame 8.

When the blanks 16 and 50 are turned in, the side-face zones 24 for the body 2 and their corresponding inner side flaps 26 are pasted together with the side flaps 52 for the inner frame 8 between them. The side-face zones 38 for the lid 4 and their corresponding inner side flaps 40 are also pasted together.

For the lid 4, moreover, the inner front flap 44 is turned in toward the inside of the front-face zone 36 and pasted on the zone 36. Since the engaging portion 48 has no paste thereon when this is done, it cannot be pasted on the front-face zone 36. More specifically, the engaging portion 48 is separated from the inner surface of the lid 4 when the hinged-lid pack is formed, as shown in FIG. 3.

As mentioned before, the 20 filter cigarettes to be packed are fed as the body 2 and the lid 4 are formed from the blanks 16 and 50. When the body 2 and the lid 4 are completed, the lid 4 is put on the open end portion of the body 2, thereby closing the body 2, as shown in FIG. 3. In this state, the opening edge of the outer frame 6 of the body 2 and the front opening edge of the lid 4 coincide with each other.

Figure 3:
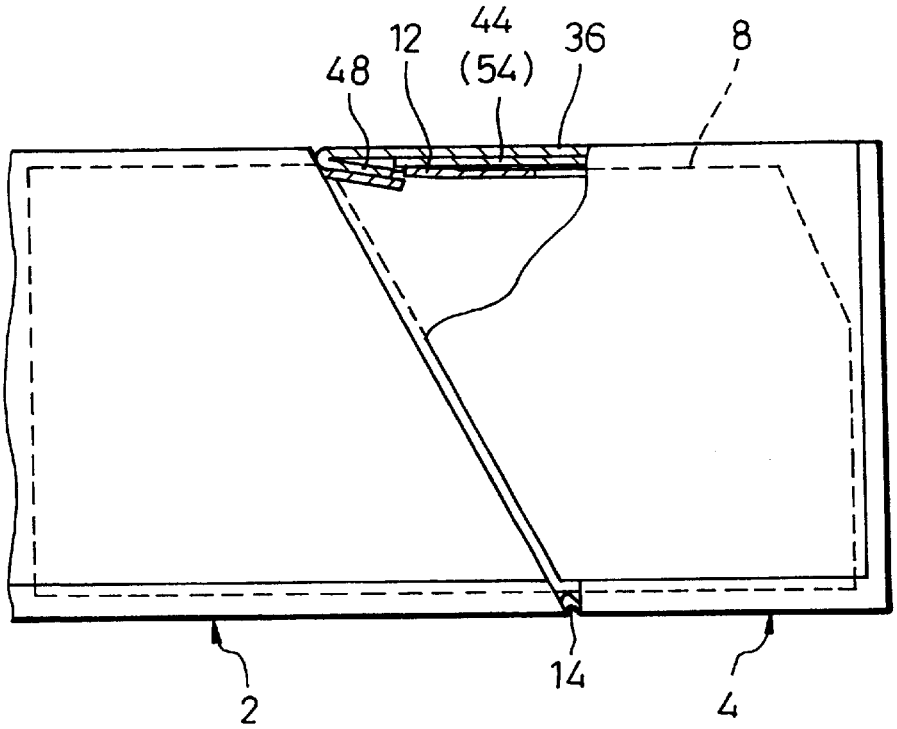
FIG. 3 is a view, partially in section, showing a part of the pack of FIG. 1.

As seen from FIG. 3, a turn line for the inner front flap 44 forms the front portion of the opening edge of the lid 4. When the flap 44 is tacked inside the lid 4, the front opening edge portion of the lid 4 has a reinforced dual structure.

As mentioned before, the length $L_2$ of the engaging portion 48 is shorter than the distance $L_3$ from the opening edge of the outer frame 6 to the distal end of the lug 12. When the lid 4 is put on fully to close the body 2, therefore, the engaging portion 48 is in contact with or at a short distance from the distal end of the lug 12 of the inner frame 8. The distal end of the lug 12 is in contact with the inner surface (tongue portion 54) of the lid 4. In the case shown in FIG. 3, the engaging portion 48 is kept off the distal end of the lug 12. Moreover, as shown in the shut state, a portion of the inner frame 8 is bent inward; and as illustrated, the lug 12 and the inner frame 8 are separated by a discontinuity therebetween.

Figure 4:
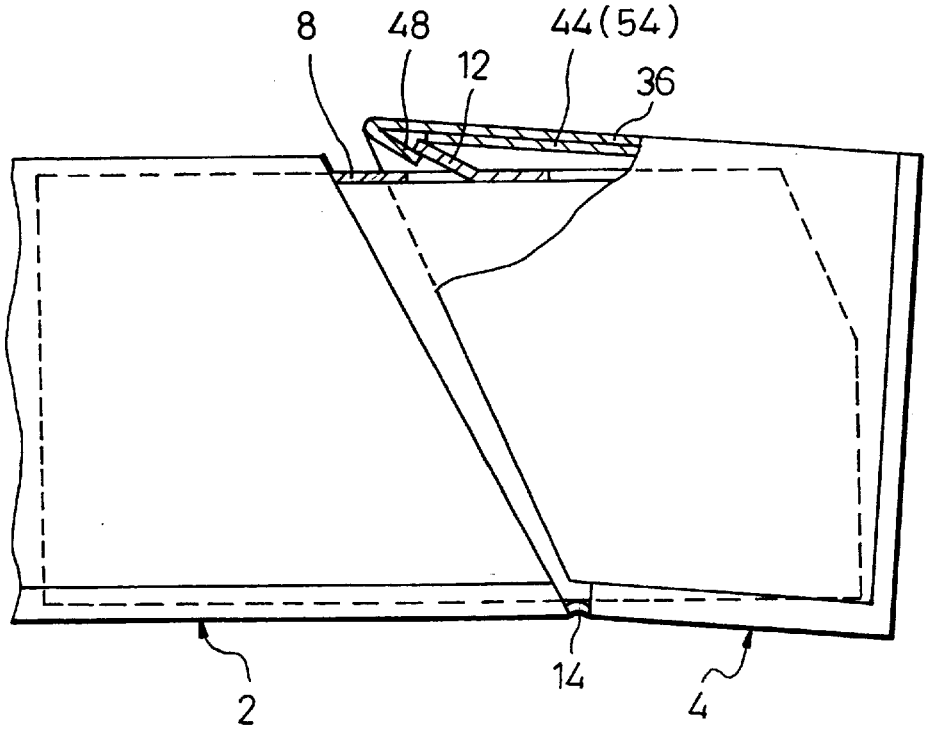
FIG. 4 is a view showing a lid having started to be lifted from the position of FIG. 3.

When the lid 4 in this state is rocked around the self-hinges 14 to be lifted slightly, the distal end of the lug 12 is inserted into the gap between the inner surface of the lid 4 and the engaging portion 48 to be held therein, as shown in FIG. 4. Thus, the lug 12 and the engaging portion 48 engage each other, so that the lid 4 is locked to the body 2.

As the lid 4 is further rocked in the opening direction, thereafter, its engaging portion 48 raises the lug 12. When the engaging portion 48 is disengaged from the lug 12, the lug 12 is flipped by the engaging portion 48, as indicated by the arrow in FIG. 5, and produces a click to indicate that the lid 4 is just lifted. Thereupon, the lug 12 is restored to its original raised position in a free state. Thereafter, the lid 4 can be easily shifted from the state of FIG. 5 to a fully-lifted position shown in FIG. 6 by being further rocked in the opening direction.

Figure 7:
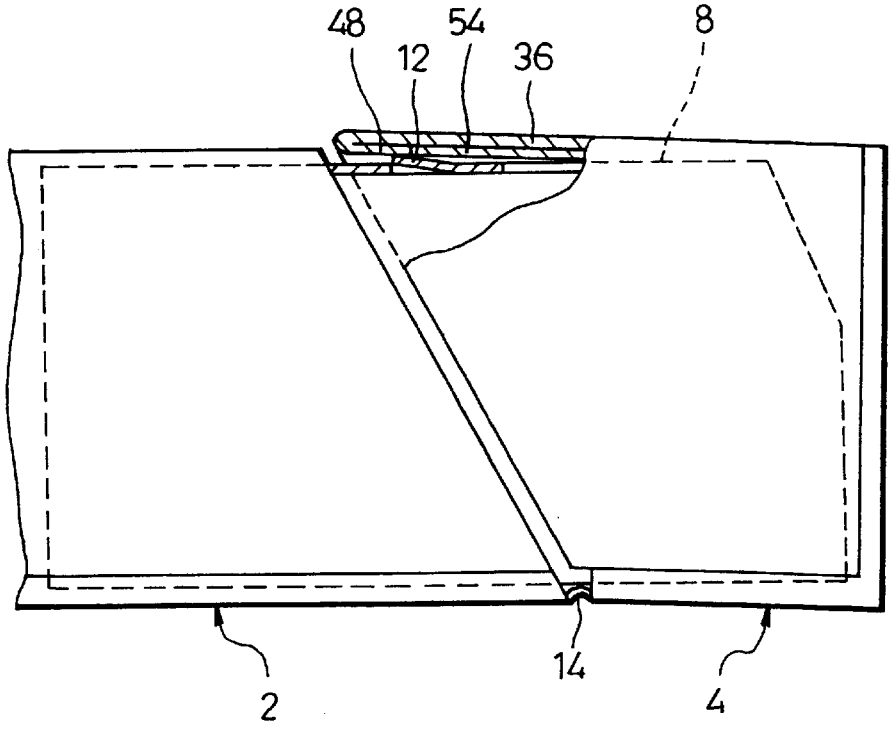
FIG. 7 is a view showing a state immediately before the lid is fully shut down.

When the lid 4 is then rocked in the opposite direction or closing direction, thereafter, its engaging portion 48 flattens and clears the lug 12 of body 2, as shown in FIG. 7. When this is done, the engaging edge of the engaging portion 48 is separated from the inner surface of the lid 4, so that the engaging portion 48 positively flattens the lug 12. When the lug 12 is entirely cleared by the engaging portion 48, it vigorously springs back to hit the inner surface of the lid 4, that is, the tongue portion 54, thereby producing a click to indicate that the lid 4 is about to be fully shut down. When the lid 4 is fully shut down, thereafter, the engaging portion 48 is separated from the distal end of the lug 12, as shown in FIG. 3.

As the lid 4 is lifted, the lug 12 is flipped as a reaction of its turn. When the lid 4 is put on, on the other hand, the lug 12 causes the tongue portion 54 to hit the inner surface of the lid 4, that is, the front-face zone 36. In either case, the inner frame 8 and the front-face zone 36 can vibrate satisfactorily, thereby producing distinct clicks. When these clicks were measured at a distance of 30 cm from the hinged-lid pack, their sound intensities were found to range from 13 to 20 dB.

The lug 12 and the engaging portion 48 are provided near the respective front opening edges of the body 2 and the lid 4, respectively. When the lid 4 is lifted, therefore, the engaging portion 48 never substantially raises the lug 12, so that the lug 12 can maintain the elastic force of its basal part for a long period. Thus, even after the open-close operation of the lid 4 is frequently repeated, distinct clicks can be produced securely.

When the lid 4 is on, the distal end of the lug 12 is inserted into the gap between the inner surface of the lid 4 and the engaging portion 48 if the lid 4 is urged to be lifted only slightly. Thus, the engagement between the engaging portion 48 and the lug 12 gives a predetermined resistance to the lifting operation of the lid 4. Accordingly, the lid 4 cannot be unlocked unless this engagement is broken, so that it can be prevented from being lifted unexpectedly.

Since the lug 12 and the engaging portion 48 are formed integrally with the inner frame 8 and the lid 4, respectively, the constructions of the body 2 and the lid 4 cannot be complicated.

Since the lug 12 is formed by being raised from the inner frame 8, moreover, it can be machined more easily than a lug that extends integrally from the lower edge of the notch 10 of the frame 8 and is turned or a lug that is bonded to the front face of the frame 8.

The width of the tongue portion 54 of the lid 4, that is, the length $W_3$ of the base of the slit C, is greater enough than the length $L_2$ of the engaging portion 48. Although the open-close operation of the lid 4 is repeated, therefore, the extent of separation of the engaging portion 48 cannot be increased unreasonably. Thus, the rigidity of the engaging portion 48 cannot be reduced, and there is no possibility of the lid 4 failing to be locked or to produce clicks.

Referring now to FIGS. 8 to 12, a hinged-lid pack according to a second embodiment of the invention will be described.

Figure 8:
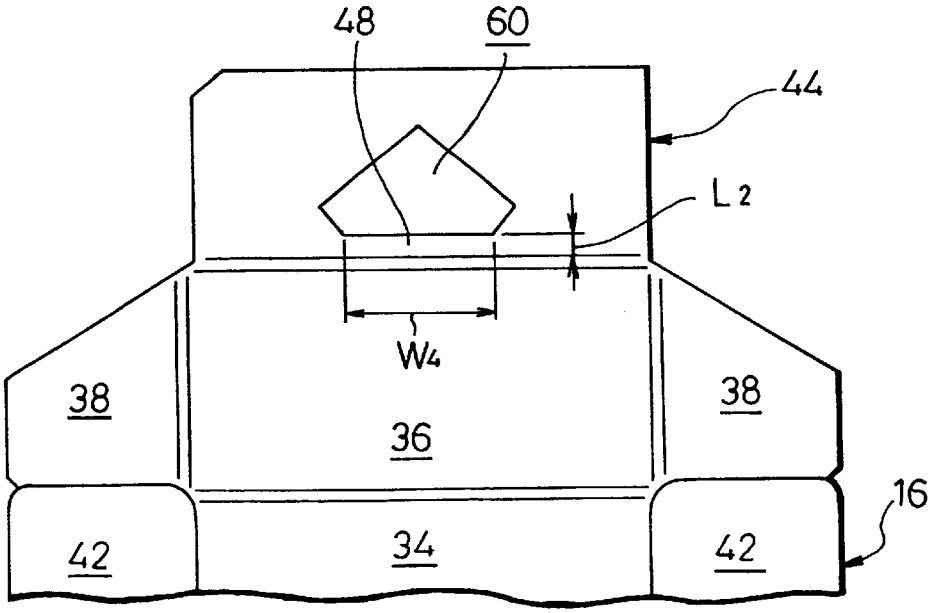
FIG. 8 a detailed view showing a blank having a cutout hole in its inner front flap.

Referring first to FIG. 8, there is shown an enlarged view of a part of the blank 16 of FIG. 2 corresponding mainly to the inner front flap 44 and the front-face zone 36.

In this second embodiment, a cutout hole 60 is formed in the central portion of the inner front flap 44 of the blank 16. The cutout hole 60 opens in the central portion of the flap 44. The hole 60 has the shape of a pentagon whose vertex is situated on the distal end side of the flap 44.

Also in the embodiment, a distance $L_2$ similar to that of the first embodiment is secured between the cutout hole 60 and the front-face zone 36. In the inner front flap 44, therefore, the engaging portion 48 is formed between the hole 60 and the zone 36.

The pentagonal shape of the cutout hole 60 shown in FIG. 8 can be obtained by symmetrically cutting off both base-angle portions of an isosceles triangle whose base adjoins the engaging portion 48. A pair of sides defined at the cut base-angle portions, that is, the opposite end sides of the base, are short oblique sides that approach each other with distance from the vertex. Thus, according to the second embodiment, the engaging portion 48 is formed in the region between the base of the cutout hole 60, the short oblique sides at the opposite ends thereof, and the front-face zone 36. A minimum width (base length of the cutout hole 60) $W_4$ of the engaging portion 48 is longer than the width $W_1$ of the distal end of the lug 12 and shorter than the width $W_2$ of the basal part of the lug 12.

Figure 9:
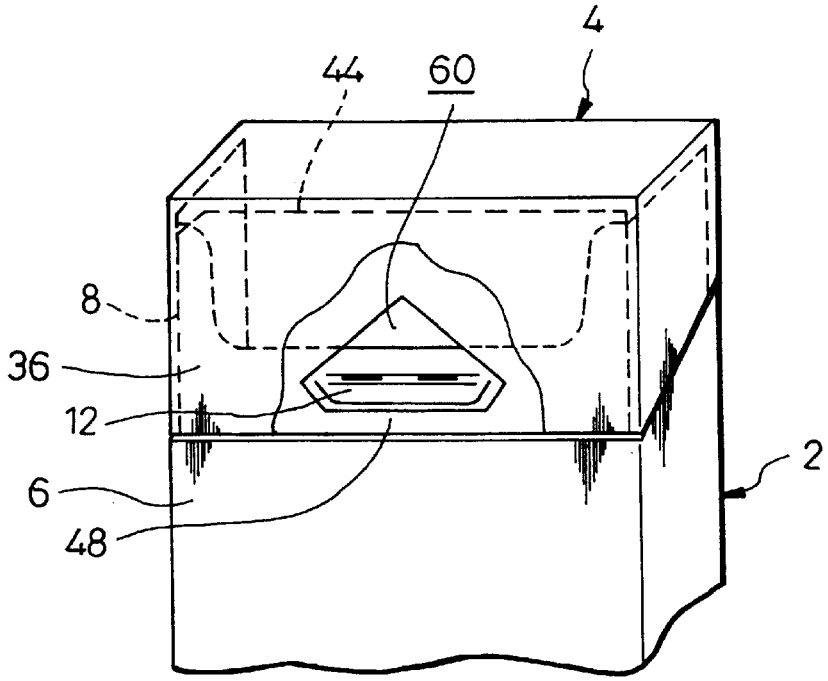
FIG. 9 is a perspective view showing the lid of the pack formed from the blank of FIG. 8 is in a shut state.

Referring to FIG. 9, there is shown an upper half of a hinged-lid pack that is formed from the blank 16 of FIG. 8.

When the lid 4 is fully shut down, as shown in FIG. 9, the lug 12 inside the lid 4 is situated entirely in the cutout hole 60.

Figure 10:
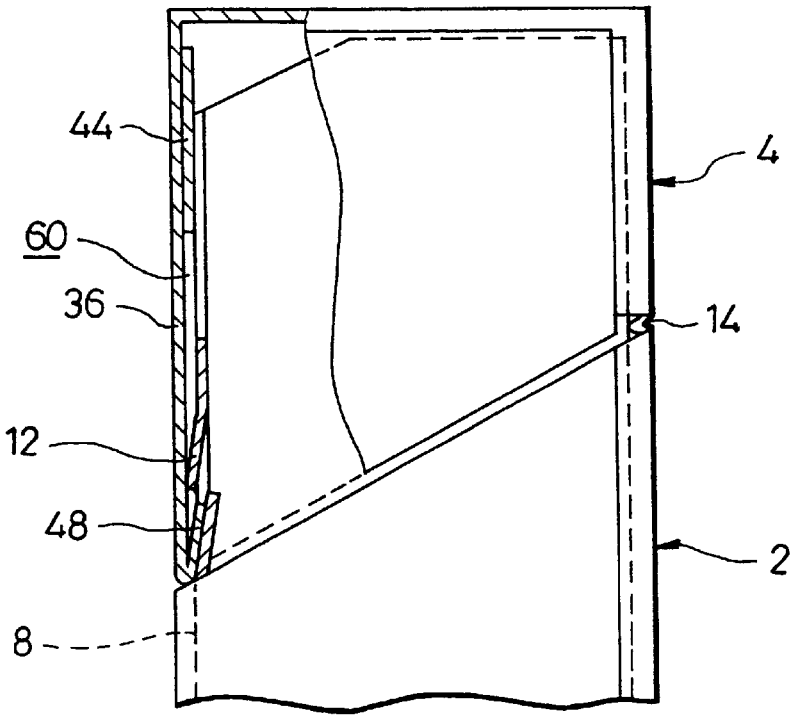
FIG. 10 a view, partially in section, showing a part of the pack FIG. 9.

Referring to FIG. 10, moreover, there is shown only a part of a profile of the front opening edge portion of the lid 4 in its shut state. In this state, the engaging portion 48, like that of the first embodiment, is separated from the distal end of the lug 12, as shown in FIG. 10. Further, the distal end of the lug 12 is in contact with the inner surface of the lid 4, that is, the front-face zone 36.

Figure 11:
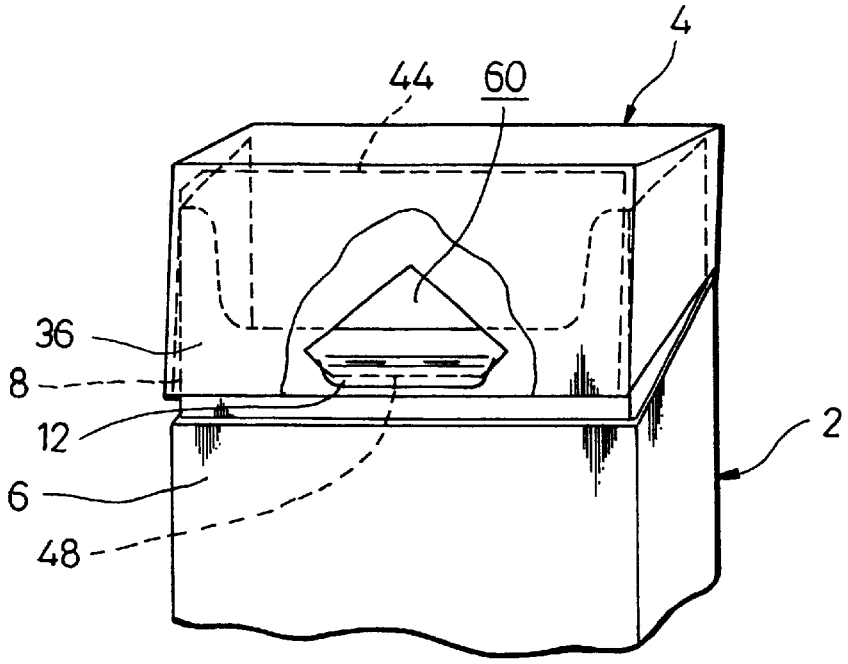
FIG. 11 is a perspective view showing the lid having started to be lifted from the position of FIG. 9.

When the lid 4 in this state is lifted slightly, the lug 12 is inserted into the cutout hole 60 to approach the inner surface of the lid 4 with its distal end portion forward, as shown in FIG. 11. Since the engaging portion 48 in this state is separated from the inner surface of the lid 4, as shown in FIG. 10, the distal end of the lug 12 can smoothly get into the hole 60 in a relative manner when the lid 4 is rocked in the opening direction.

Figure 12:
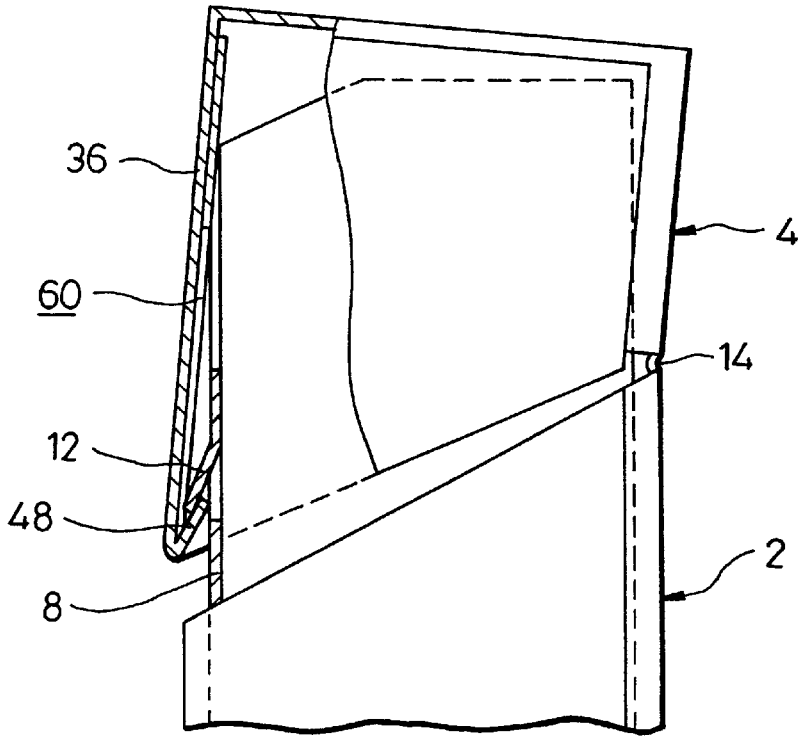
FIG. 12 is a view, partially in section, showing a part of the lid of FIG. 11 having started to be lifted.

Thereupon, the distal end of the lug 12 is sandwiched between the inner surface of the lid 4 and the engaging portion 48, as shown in FIG. 12. Thus, the lid 4 is locked to the body 2 in the same manner as in the first embodiment.

Figure 5:
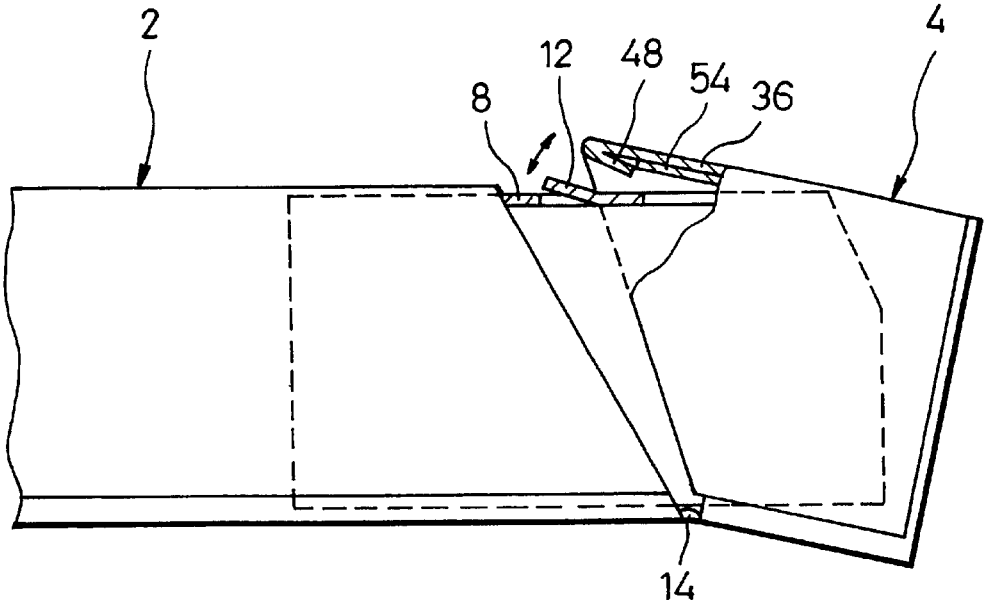
FIG. 5 is a view showing the way a lug and an engaging portion in the state of FIG. 4 are disengaged from each other.
Figure 6:
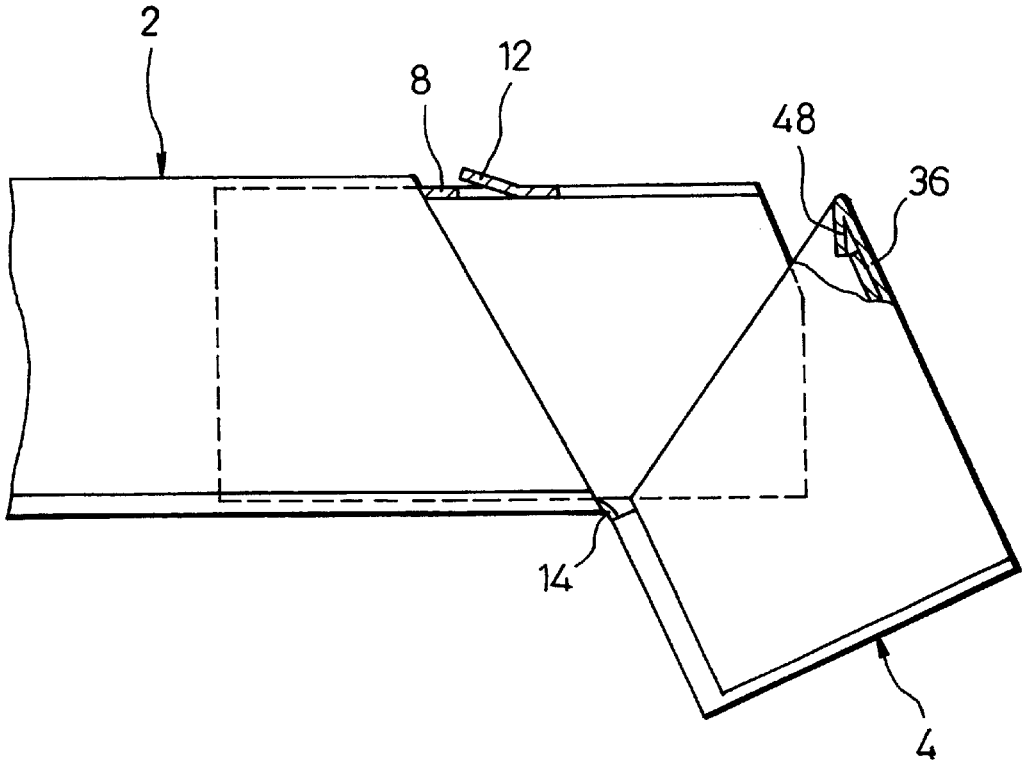
FIG. 6 is a view showing the lid in a fully-lifted state.

When the lid 4 is further rocked so that the engaging portion 48 is disengaged from the lug 12, thereafter, a click is produced to indicate that the lid 4 is lifted, in the same manner as in the first embodiment shown in FIG. 5. When the lid 4 in this lifted state is rocked in the opposite direction to be shut down, moreover, the lug 12 vigorously springs back to hit the inner surface of the lid 4, thereby producing a click, as in the first embodiment.

The way of engagement between the lug 12 and the engaging portion 48 of the hinged-lid pack according to the second embodiment is different from that according to the first embodiment. According to the first embodiment, the entire distal end portion of the lug 12 engages the engaging portion 48. According to the second embodiment, in contrast with this, the opposite side edges of the lug 12 and the two short oblique sides of the pentagon overlap one another, so that the lug 12 and the engaging portion 48 engage each other, as shown in FIG. 11.

As mentioned before, the minimum width $W_4$ of the engaging portion 48 is shorter than the width $W_2$ of the basal part of the lug 12. Even when the lid 4 in the state of FIG. 11 is further rocked so that the lug 12 is inserted into the gap between the engaging portion 48 and the lid 4, therefore, the basal part of the lug 12 cannot be fully interposed between the engaging portion 48 and the inner surface of the lid 4. Accordingly, the edge of the engaging portion 48 cannot be caught by the basal part of the lug 12 when the lid 4 is lifted. Thus, the lug 12 and the engaging portion 48 can be smoothly disengaged from each other as the lid 4 rocks, so that a comfortable click can be produced securely. After the open-close operation of the lid 4 is repeated, moreover, there is no possibility of the basal part of the lug 12 tearing.

Usually, each hinged-lid pack is loaded with 20 filter cigarettes. If the lid 4 is lifted and shut down frequently with a relatively large number of cigarettes remaining in the body 2, the respective tips of the cigarettes on the front side are repeatedly rubbed by the inner surface of the lid 4 or the inner front flap 44. If the flap 44 is provided with an opening such as a cutout hole, in this case, the filer tip of each filter cigarette may possibly be caught hard by the edge of the opening, depending on the shape of the opening. However, the cutout hole 60 according to the second embodiment has the shape of the pentagon whose vertex is situated on the distal end side of the inner front flap 44. Besides, the two sides of the pentagon that settle the vertex are inclined at an angle to the rocking direction of the lid 4. Since the edge of the hole 60 is defined by these two oblique sides, the tip of each filter cigarette cannot be positively caught by the opening edge.

The cutout hole 60 may be formed in the shape of any of other polygons, such as a triangle, tetragon, etc.

Figure 13:
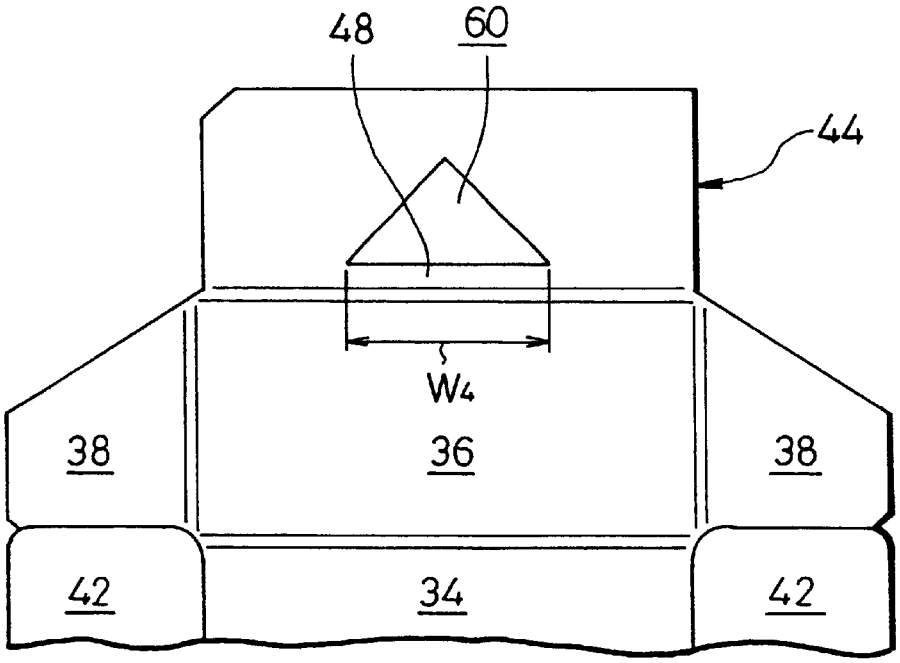
FIG. 13 is a view showing a triangular version of the cutout hole of FIG. 8.

Referring to FIG. 13, there is shown a case in which the opening of the cutout hole 60 is triangular. Also in this case, the width $W_4$ of the engaging portion 48, which is defined by the base of a triangle shown in FIG. 13, is set to be longer than the width $W_1$ of the distal end portion of the lug 12 and shorter than the width $W_2$ of the basal part of the lug 12. Thus, the lug 12 can be prevented from being broken, as mentioned before.

As seen from FIG. 13, moreover, the vertex of this triangle is situated on the distal end side of the inner front flap 44, so that the tip of each filter cigarette cannot be positively caught by the edge of the cutout hole 60 when the lid 4 is lifted or shut down.

Any of the aforementioned various shapes for the cutout hole 60 is tapered from the side of the engaging portion 48 toward the distal end of the inner front flap 44. Thus, the cutout hole 60 may be formed having the tapered shape of any of round-cornered or curve-sided versions of the aforesaid various polygons.

Figure 14:
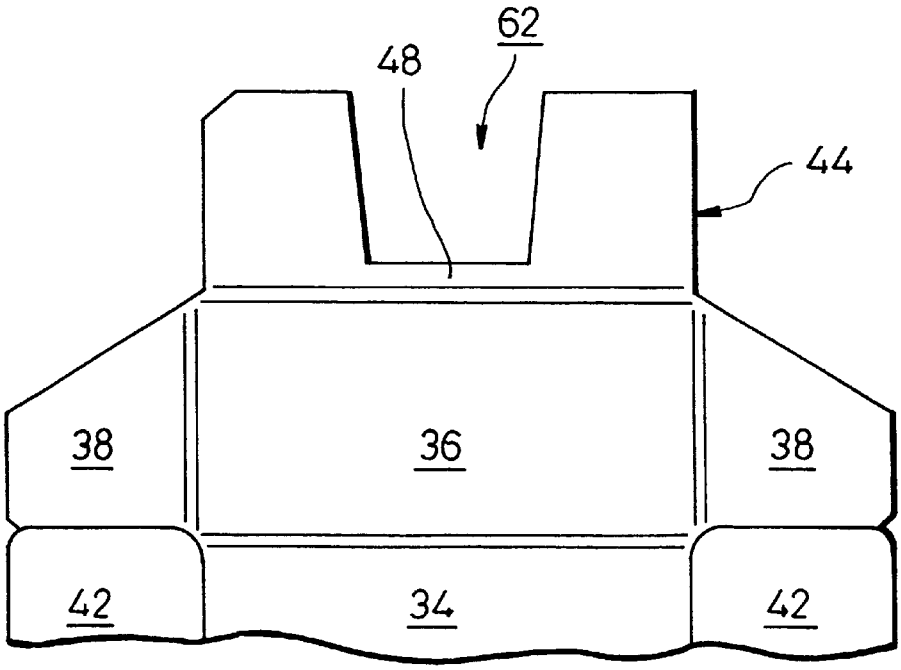
FIG. 14 is a viewshowing a modification of the inner front flap having a notch.

Referring to FIG. 14, there is shown an arrangement in which the inner front flap 44, unlike the ones according to the two foregoing embodiments, is provided with neither the slit C nor the cutout hole 60, but with a notch 62 in its central portion. In this case, the notch 62 has the shape of an inverted trapezoid that extends from the distal end of the flap 44 toward the front-face zone 36, and the engaging portion 48 is defined between the base of the trapezoid and the zone 36.

Figure 15:
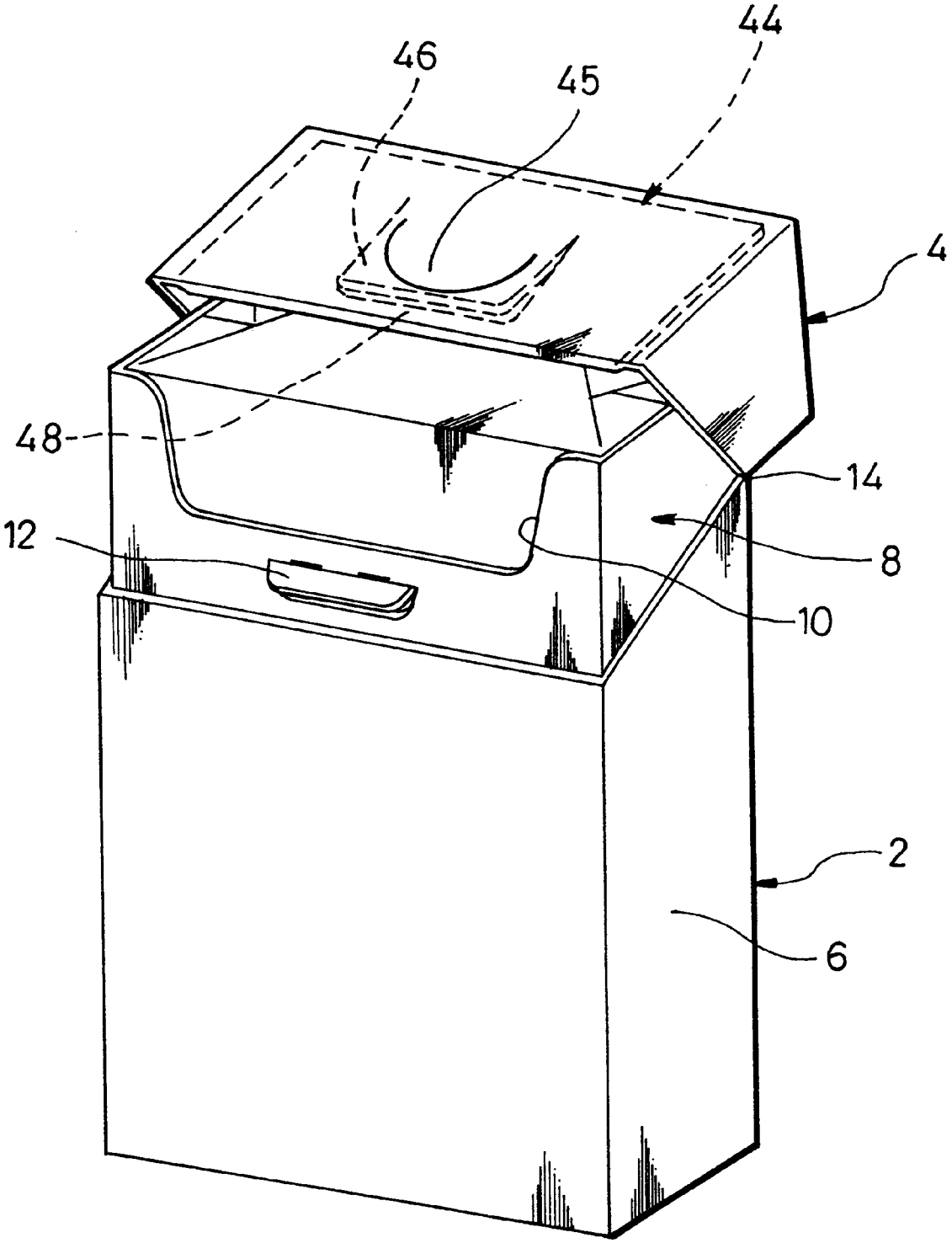
FIG. 15 is a perspective view showing a hinged-lid pack according to a third embodiment of the invention.

Referring to FIG. 15, there is shown a hinged-lid pack according to a third embodiment of the invention.

The hinged-lid pack of the third embodiment has a push tongue portion 45 on its front wall. The inner front flap 44 is provided with a release tongue portion 46.

Figure 16:
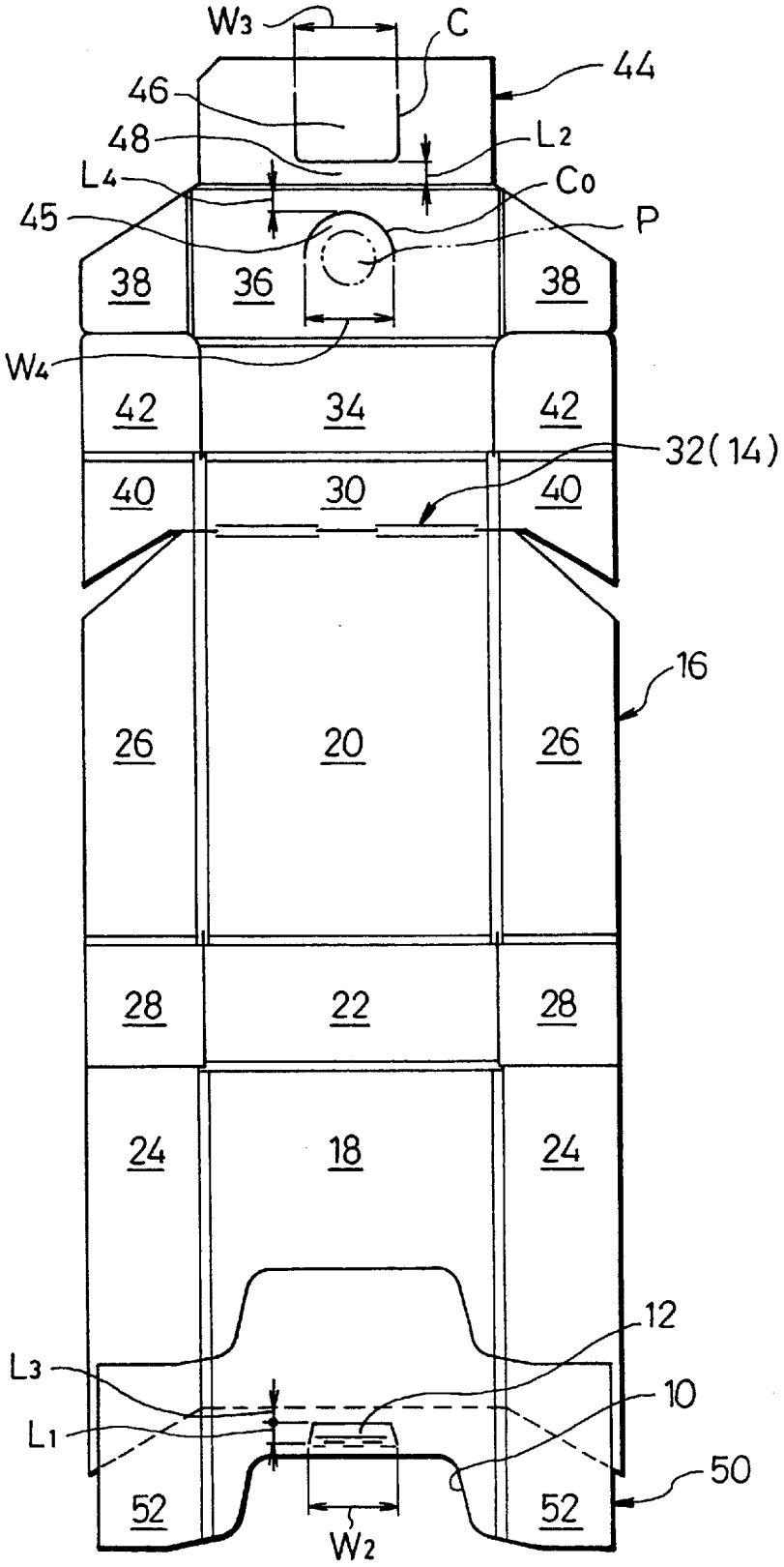
FIG. 16 is a view showing a blank from which the pack of FIG. 15 is formed.

FIG. 16 shows the blanks 16 and 50 for the hinged-lid pack of the third embodiment. In the blank 16 of FIG. 16, a circular outer slit $C_0$ is cut in the central portion of the front-face zone 36.

The outer slit $C_0$ is convex toward the inner front flap 44. A given distance $L_4$ is secured between the summit of the arc of the slit $C_0$ and the front opening edge portion of the lid 4. The distance $L_4$ is longer than the aforesaid distance $L_2$.

When the hinged-lid pack is completed using the blanks 16 and 50 of FIG. 16, that portion of the front-face zone 36 which is surrounded by the outer slit $C_0$ constitutes the push tongue portion 45 that can be pushed in from the front side of the lid 4. That portion of the inner front flap 44 which is surrounded by the inner slit C constitutes the release tongue portion 46. The tongue portion 46 is designed to be pushed in together with the push tongue portion 45.

In the blank 16 of FIG. 16, the width $W_3$ of the engaging portion 48 is about 20 mm, for example. The width $W_3$ is equal to the width of the release tongue portion 46. On the other hand, a maximum width $W_4$ of the push tongue portion 45 is equal to the distance between the opposite ends of the outer slit $C_0$, and is shorter (e.g., about 16 mm) than the width $W_3$ of the engaging portion 48.

Other parts of the blanks 16 and 50 are arranged substantially in the same manner as the ones according to the first embodiment.

Preferably, the inner front flap 44 should be pasted in the position of a circle P (two-dot chain line in FIG. 16) when the blanks 16 and 50 of FIG. 16 are turned in. However, the pasting position for the flap 44 is not limited to this position. The engaging portion 48, like that of the first embodiment, is not pasted on the front-face zone 36, so that the lug 12 raised from the inner frame 8 can be sandwiched between the engaging portion 48 and the inner surface of the lid 4.

As mentioned before, moreover, the distance $L_4$ between the turn line for the inner front flap 44 and the distal end of the push tongue portion 45 is longer than the length $L_2$ of the engaging portion 48. When the flap 44 is turned in and pasted, therefore, the push tongue portion 45 and the engaging portion 48 never overlap each other. On the other hand, the maximum width $W_4$ of the push tongue portion 45 is shorter than the maximum width $W_3$ of the release tongue portion 46. In the region outside the release tongue portion 46, therefore, the push tongue portion 45 never overlaps the inner front flap 44.

Thus, after the inner front flap 44 is turned in and pasted on the front-face zone 36, the push tongue portion 45 overlaps the flap 44 only within the region of the release tongue portion 46, as shown in FIG. 15. When the push tongue portion 45 is pushed in from the front side of the lid 4 in this state, only the release tongue portion 46 of the flap 44 is satisfactorily pushed into the pack.

Figure 17:
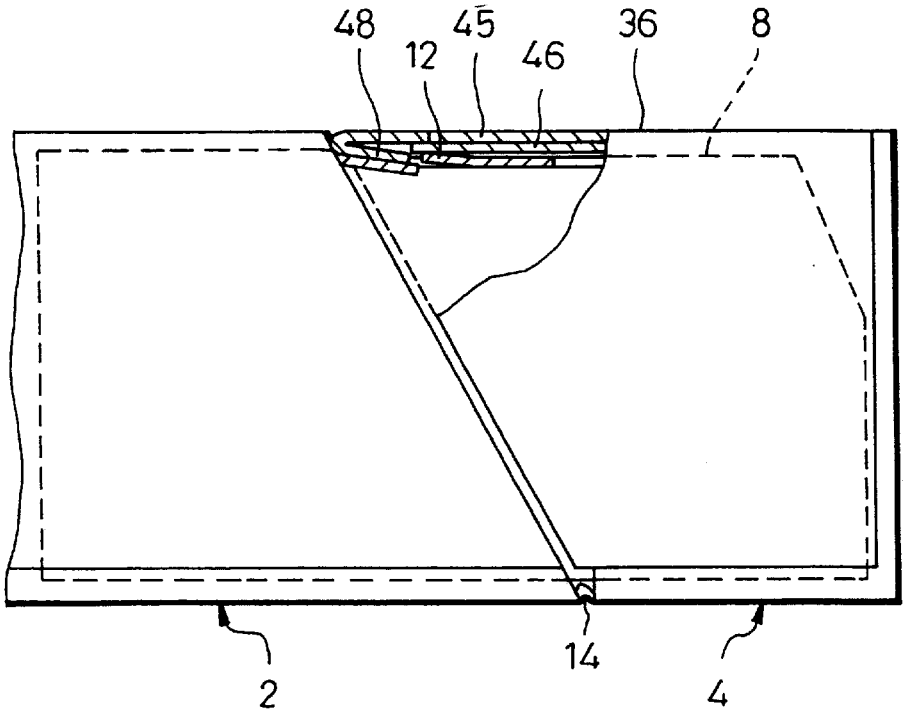
FIG. 17 is a view, partially in section, showing a part of the pack of FIG. 15.

Referring to FIG. 17, there is shown a state in which the lid 4 is put on so that the hinged-lid pack of the third embodiment is fully closed. As shown in FIG. 17, the distal end of the lug 12 is in contact with the release tongue portion 46.

As mentioned before, moreover, the engaging portion 48 is not pasted on the inner surface of the lid 4 and is separated from it. Preferably, on the other hand, the release tongue portion 46 is pasted on the inner surface of the lid 4 and is intimately in contact with it. On the inner surface of the lid 4, therefore, there is a difference in level between the engaging portion 48 and the release tongue portion 46, as shown in FIG. 17. It is to be understood that the release tongue portion 46 can come intimately into contact with the inner surface of the lid 4 even if the inner front flap 44 is not pasted specifically in the aforesaid position on the front-face zone 36.

Figure 18:
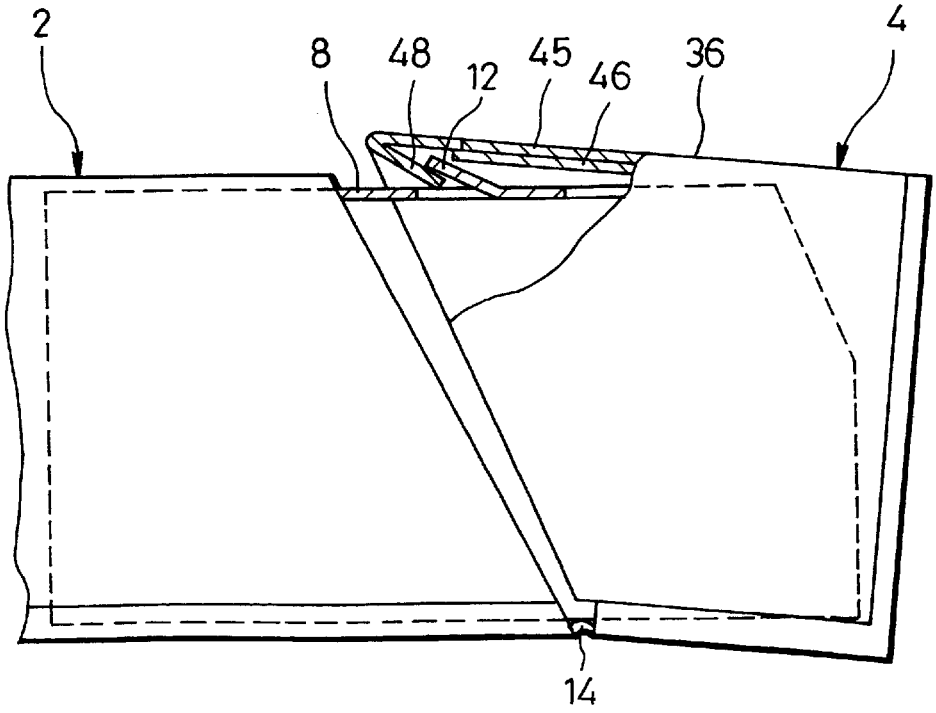
FIG. 18 is a view showing the lid having started to be lifted from the position of FIG. 17.

When the lid 4 in this fully-shut position is rocked around its self-hinges 14 to be lifted slightly, the lug 12 is urged to return to its original raised position by means of the urging force of its basal part. While the lid 4 thus rocks slightly, therefore, the distal end of the lug 12 is kept in engagement with the release tongue portion 46. On the other hand, the engaging portion 48 is also urged to be separated further from the inner surface of the lid 4 by its restoring force. As a result, the difference in level between the release tongue portion 46 and the engaging portion 48 increases. At this time, the lug 12 is relatively inserted into the gap between the engaging portion 48 and the inner surface of the lid 4 through the base portion of the slit C, that is, a step portion between the portions 46 and 48, as shown in FIG. 18. Thus, the distal end of the lug 12 is interposed between the inner surface of the lid 4 and the engaging portion 48, whereupon the lid 4 is locked to the body 2.

With the lug 12 and the engaging portion 48 in engagement with each other in this state, the lid 4 is entirely locked to the body 2 and cannot be further rocked to be lifted unexpectedly.

On the other hand, a user can easily lift the lid 4 by rocking it so that it is unlocked, that is, lest the lug 12 be sandwiched. The following is a description of the operation for lifting the lid 4 that involves the unlocking operation.

Figure 19:
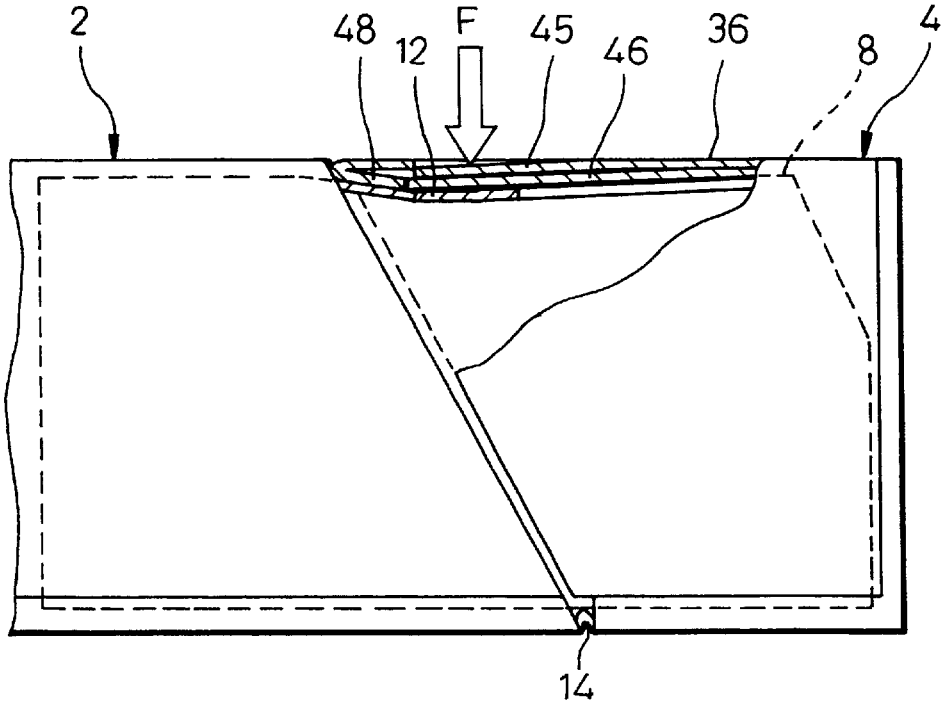
FIG. 19 is a view showing a push tongue portion pushed in from the position shown in FIG. 17.

If a pushing force F (indicated by arrow in FIG. 19) is applied to the push tongue portion 45 from the front side of the lid 4 in the shut state, as shown in FIG. 19, the release tongue portion 46 is pushed together with the tongue portion 45 into the hinged-lid pack. When the release tongue portion 46 is thus pushed in, it is warped toward the interior of the pack, so that the difference in level between the engaging portion 48 and the tongue portion 46 is eliminated. Further, the lug 12 is pushed in and back from its raised position by the release tongue portion 46.

Figure 20:
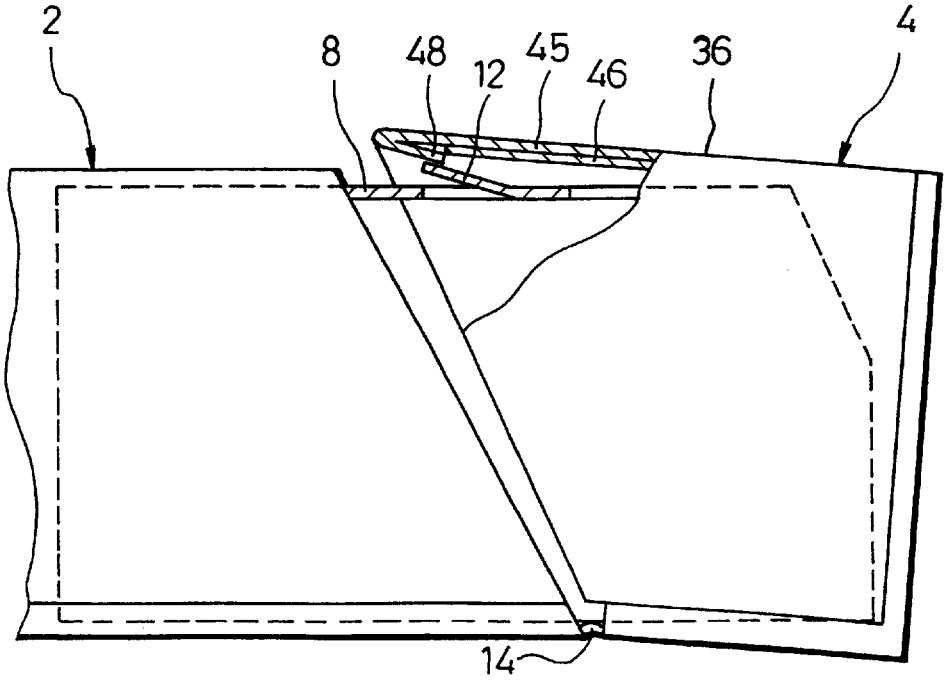
FIG. 20 is a view showing the lid having started to be lifted from the position of FIG. 19.

When the lid 4 is rocked slightly in the opening direction with the push tongue portion 45 pushed in, the inner surface of the lid 4 leaves the front face of the inner frame 8, so that the lug 12 is gradually restored its original raised position by its own elastic force. Even when this is done, however, there is still no difference in level between the engaging portion 48 and the release tongue portion 46, as mentioned before, so that the distal end of the lug 12 cannot be inserted into the gap between the engaging portion 48 and the inner surface of the lid 4. When the lid 4 is rocked to a position such that the engaging portion 48 and the lug 12 overlap each other, thereafter, there is no possibility of the engaging portion 48 and the lug 12 engaging each other to lock the lid 4 although the push on the push tongue portion 45 is removed, as shown in FIG. 20. Thus, the lid 4 can be easily lifted as it is.

Figure 21:
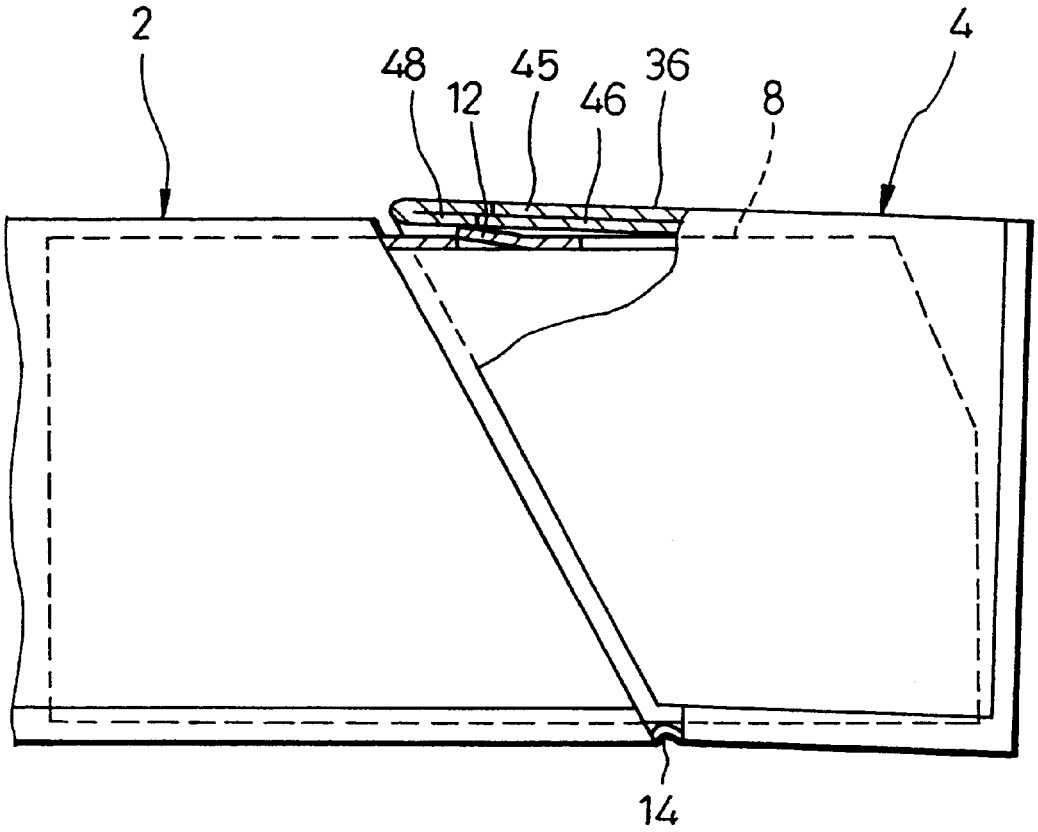
FIG. 21 is a view showing a state immediately before the lid of the pack of FIG. 15 is fully shut down.

When the lid 4 in the fully-lifted position is oppositely rocked to be shut down, its engaging portion 48 flattens and clears the lug 12 and is pressed against the inner surface of the lid 4, as shown in FIG. 21. When the lug 12 is entirely cleared by the engaging portion 48, these two members are brought to the state shown in FIG. 17, whereupon the lid 4 is fully shut down.

According to the hinged-lid pack of the third embodiment, the lid 4 can be lifted without following the aforementioned steps of procedure. More specifically, the lug 12 and the engaging portion 48 can be disengaged from each other by further rocking the lid 4 from the position shown in FIG. 18 without pushing in the push tongue portion 45 in the aforesaid manner. In this case, the distal end of the lug 12 is inserted in the gap between the inner surface of the lid 4 and the engaging portion 48, so that the engaging portion 48 raises the lug 12 as the lid 4 is rocked. When the lid 4 is further rocked so that the engaging portion 48 gets over the lug 12, thereafter, the lug 12 and the engaging portion 48 are discharged from each other, as shown in FIG. 8. As this is done, the lug 12 is flipped as a reaction of its turn in the same manner as in the first embodiment, thereby producing a click to indicate that the lid 4 is lifted. Also when the lid 4 in the state shown in FIG. 21 is fully shut down, the lug 12 springs back to hit the inner surface of the lid 4 or the release tongue portion 46, thereby producing a click.

In the case of the hinged-lid pack according to the third embodiment, the lid 4 can be easily prevented from being locked by being lifted in a manner such that the push tongue portion 45 is pushed in from the front side of the lid 4 at the user's request. Thus, the lug 12 and the engaging portion 48 undergo no substantial deformation when the lid 4 is lifted, so that they can be prevented from being broken.

When the lid 4 in the locked state is further rocked to be lifted, a click is produced to indicate that the engaging portion 48 and the lug 12 are disengaged from each other, that is, unlocking the lid 4 is completed, so that the user can securely recognize by the click that the lid 4 is unlocked.

The push tongue portion 45 and the release tongue portion 46 for the aforesaid unlocking operation are formed by only providing the front-face zone 36 and the inner front flap 44 for the lid 4 with the slits $C_0$ and C, respectively, so that the construction of the lid 4 cannot be complicated. Since the engaging portion 48, as well as the release tongue portion 46, can be formed by only providing the inner front flap 44 with the slit C, moreover, these portions 46 and 48 can be machined more easily.

The inner front flap 44 for the lid 4 is bonded at the release tongue portion 46. Besides, the width $W_3$ of the tongue portion 46 is longer enough than the length $L_2$ of the engaging portion 48. Although the lid 4 is lifted and shut down repeatedly, therefore, the extent of separation of the engaging portion 48 cannot be increased unreasonably. Thus, the rigidity of the engaging portion 48 can be kept at a high level, and the lockability of the lid 4 can be maintained for a long period.

The following is a hinged-lid pack according to a fourth embodiment of the invention.

Figure 22:
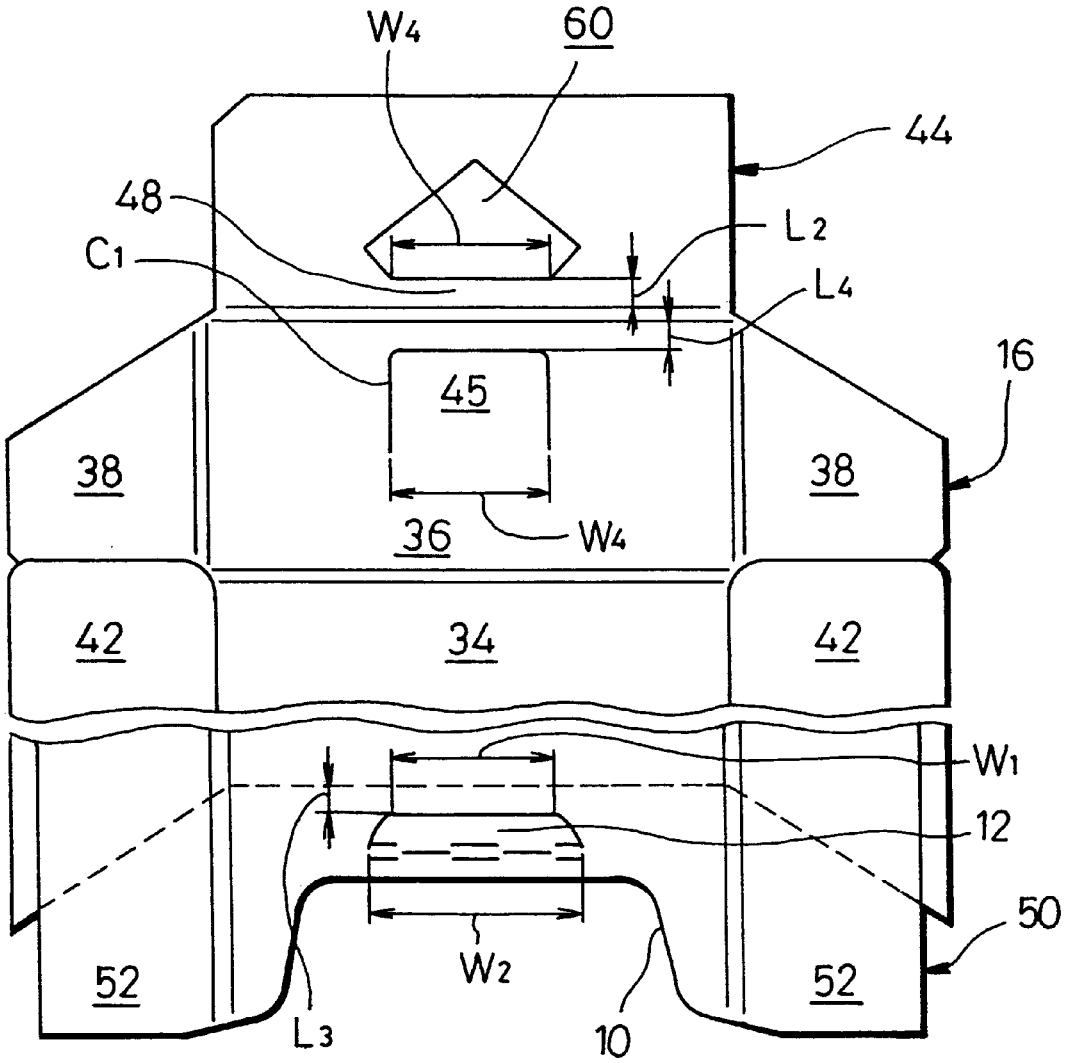
FIG. 22 is a view showing a modification of the blank of FIG. 16.

FIG. 22 is an enlarged view showing the inner front flap 44 and the front-face zone 36 of the blanks 16 and 50 of FIG. 16 and the lug 12 of the inner frame 8.

The inner front flap 44 is not provided with any slit in its central portion, but has the cutout hole 60 instead, which has been described in detail in connection with the second embodiment.

On the other hand, an outer slit $C_1$ is cut in the front-face zone 36, that is, the front side wall of the lid 4. The slit $C_1$, which has the shape of an inverted U, extends toward the front opening edge of the lid 4. That portion of the front-face zone 36 which is surrounded by the outer slit $C_1$ constitutes the push tongue portion 45, as in the third embodiment.

As mentioned before, the inner front flap 44 is not provided with any slit. In the case of the hinged-lid pack according to the fourth embodiment, therefore, the inner front flap 44 has no release tongue portion.

The distance $L_2$ is secured between the cutout hole 60 and the front-face zone 36. In the inner front flap 44, the engaging portion 48 is defined in the region between the hole 60 and the zone 36. In this case, the distance $L_4$ between the flap 44 and the top side portion of the outer slit $C_1$ is equal to the distance $L_2$.

The lug 12 is formed by being raised from the inner frame 8. The minimum width (base length of the cutout hole 60) $W_4$ of the engaging portion 48 is longer than the width $W_1$ of the distal end of the lug 12 and shorter than the width (maximum width) $W_2$ of the basal part of the lug 12.

Figure 23:
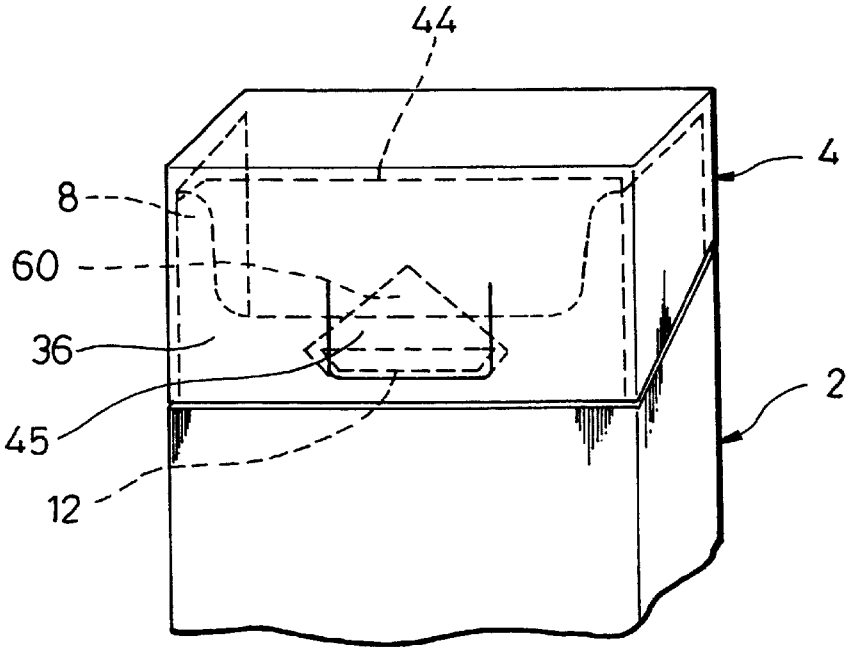
FIG. 23 is a perspective view showing the lid of the pack formed from the blank of FIG. 22 is in a shut state.

Referring to FIG. 23, there is shown an upper half of a hinged-lid pack that is formed from the blanks 16 and 50. When the lid 4 is fully shut down, as shown in FIG. 23, the lug 12 inside the lid 4 is situated entirely in the cutout hole 60.

Figure 24:
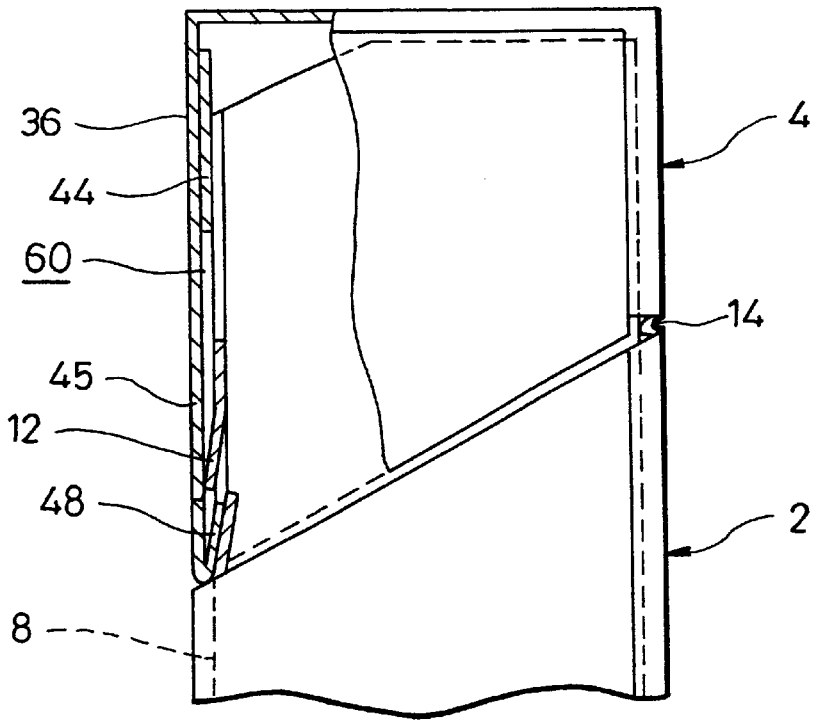
FIG. 24 is a view, partially in section, showing a part of the of pack FIG. 23.

Referring to FIG. 24, moreover, there is shown a profile of the front wall of the lid 4 in its shut position. In this state, the engaging portion 48, like those of the foregoing embodiments, is separated from the distal end of the lug 12, as shown in FIG. 24, and the distal end of the lug 12 is in contact with the inner surface of the lid 4, that is, the front-face zone 36.

Figure 25:
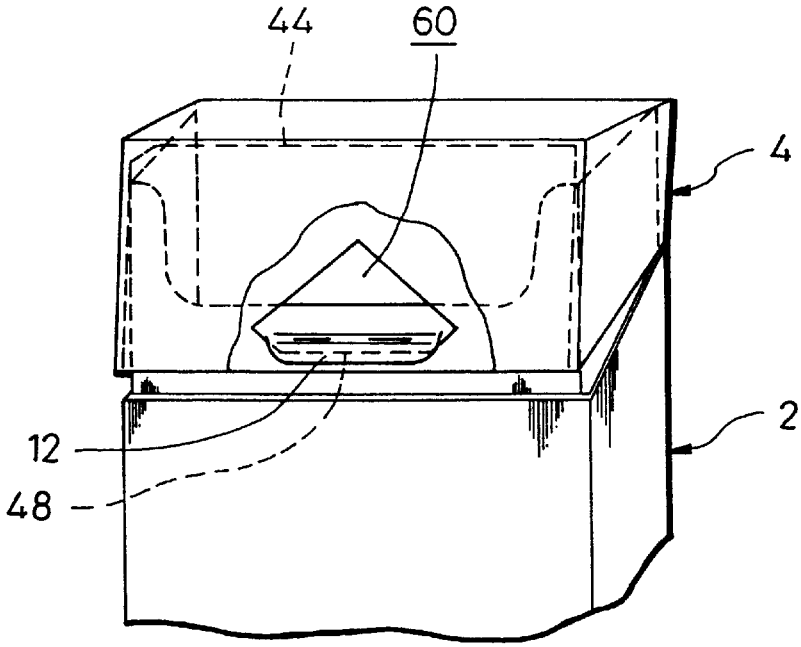
FIG. 25 is a perspective view showing the lid having started to be lifted from the position of FIG. 23.

When the lid 4 in this state is lifted slightly, the lug 12 is inserted into the cutout hole 60 to approach the inner surface of the lid 4 with its distal end forward, as shown in FIG. 25. Since the engaging portion 48 in this state is separated from the inner surface of the lid 4, as shown in FIG. 24, the distal end of the lug 12 can be smoothly inserted into the hole 60 in a relative manner when the lid 4 is rocked in the opening direction.

Figure 26:
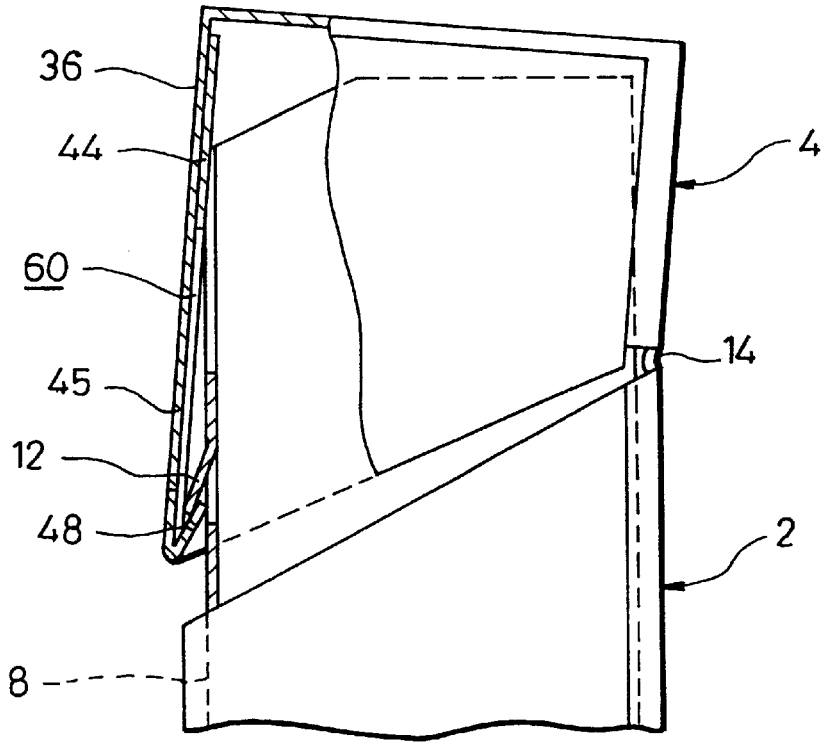
FIG. 26 is a view, partially in section, showing a part of the lid of FIG. 25 having started to be lifted.

Thereupon, the distal end of the lug 12 is sandwiched between the inner surface of the lid 4 and the engaging portion 48, as shown in FIG. 26. Thus, the lid 4 is locked to the body 2 in the same manner as in the first embodiment.

Figure 27:
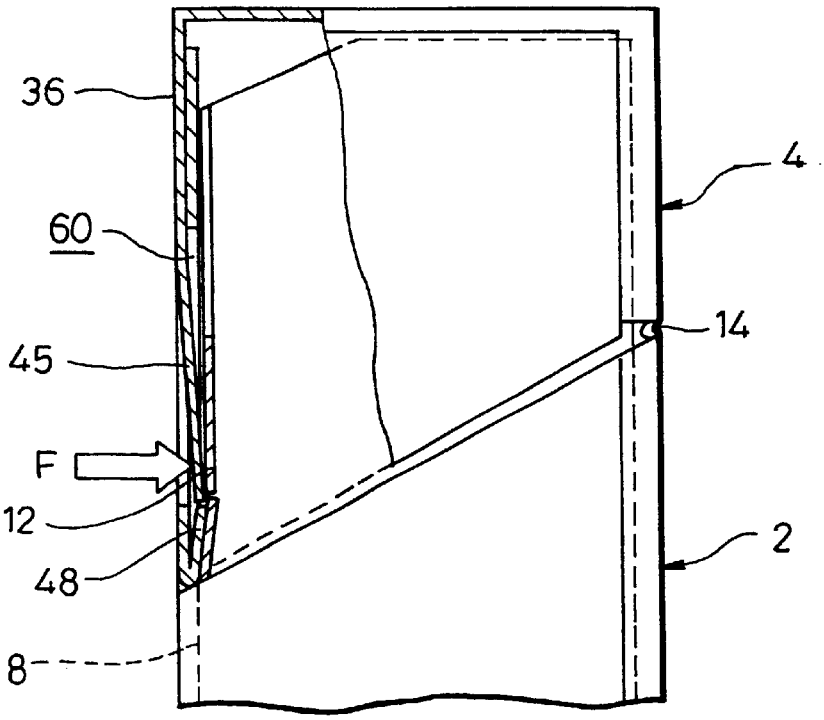
FIG. 27 is a view showing the push tongue portion pushed in from the position shown in FIG. 24.

Referring now to FIG. 27, there is shown a state in which the push tongue portion 45 is pushed in with the lid 4 on.

As mentioned before, the inner front flap 44 is not provided with any slit, such as the one according to the third embodiment. As shown in FIG. 23, on the other hand, the distal end portion of the push tongue portion 45 is situated in the cutout hole 60 as viewed from the front side of the lid 4. Therefore, the distal end portion of the tongue portion 45 can warp in the hole 60 under the pushing force F. Since the distance $L_4$ between the front opening edge of the lid 4 and the distal end of the push tongue portion 45 is equal to the distance $L_2$ of the engaging portion 48, as mentioned before, the distal end edge of the tongue portion 45 and the edge of the engaging portion 48 can be butted against each other, as shown in FIG. 27. Further, the lug 12 is pressed by means of the push tongue portion 45 so that it is pushed back from its raised position.

When the lid 4 is rocked slightly in the opening direction with the push tongue portion 45 pushed in this manner, the inner surface of the lid 4 is separated from the front face of the inner frame 8, so that the lug 12 is gradually restored to its original raised position by its own elastic force. Since the distal end edge of the tongue portion 45 and the edge of the engaging portion 48 are then butted against each other, as mentioned before, the distal end of the lug 12 cannot be inserted into the cutout hole 60. Accordingly, the distal end of the lug 12 cannot be inserted into the gap between the engaging portion 48 and the inner surface of the lid 4. When the lid 4 is rocked to a position such that the engaging portion 48 and the lug 12 overlap each other, thereafter, there is no possibility of the engaging portion 48 and the lug 12 engaging each other to lock the lid 4 although the push on the push tongue portion 45 is removed. Thus, the lid 4 can be lifted with ease.

Also in the case where the push tongue portion 45 of the hinged-lid pack according to the fourth embodiment is not pushed in, a distinct click can be produced in a manner such that the lug 12 is flipped as the lug 12 and the engaging portion 48 are satisfactorily disengaged from each other when the lid 4 is lifted. Also when the lid 4 in the lifted state is oppositely rocked to be shut down, the lug 12 springs back to hit the inner surface of the lid 4, thereby producing a click to indicate that the lid 4 is about to be fully shut down.

Figure 28:
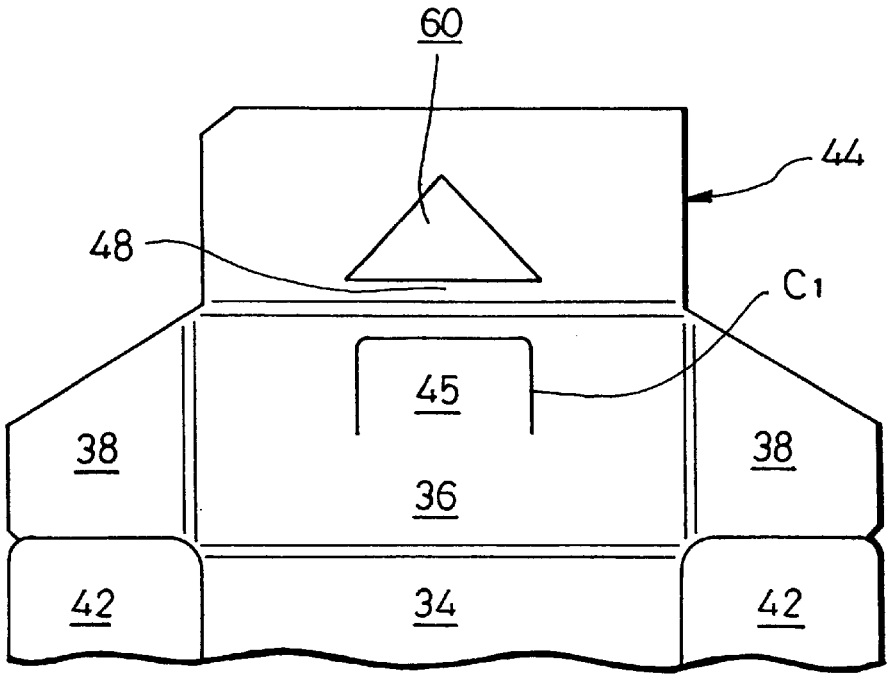
FIG. 28 is a view showing a triangular version of the cutout hole shown in FIG. 22.

Also in the fourth embodiment, the cutout hole 60 may be formed in the shape of any of other polygons, such as a triangle, tetragon, etc. Referring to FIG. 28, there is shown a case in which the opening of the cutout hole 60 is triangular. Also in this case, the push tongue portion 45 is formed by providing the front-face zone 36 with the same outer slit $C_1$ as the one shown in FIG. 22. When the tongue portion 45 is pushed in, the lug 12 can be effectively prevented from being interposed, as in the case shown in FIG. 27.

In the case where the cutout hole 60 has the shape of a triangle, the length of the base of the triangle, that is, the width $W_4$ of the engaging portion 48, is made longer than the width $W_1$ of the distal end of the lug 12 and shorter than the width $W_2$ of the basal part of the lug 12. By doing this, the lug 12 can be prevented from being broken when the lid 4 is lifted without pushing in the push tongue portion 45.

Figure 29:
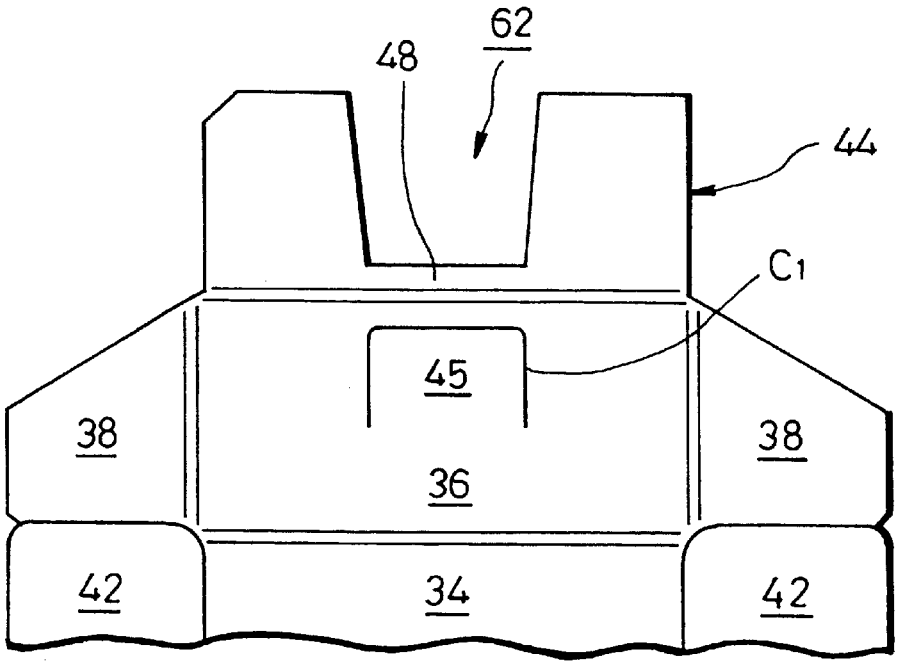
FIG. 29 is a view showing a modification of the inner front flap having a notch.

FIG. 29 shows a modification of the hinged-lid pack according to the fourth embodiment. The inner front flap 44 is not provided with any slit or cutout hole, but has the notch 62 in the central portion instead. In this case, the notch 62 has the shape of an inverted trapezoid that extends from the distal end of the flap 44 toward the front-face zone 36, and the engaging portion 48 is defined between the base of the trapezoid and the zone 36.

Figure 30:
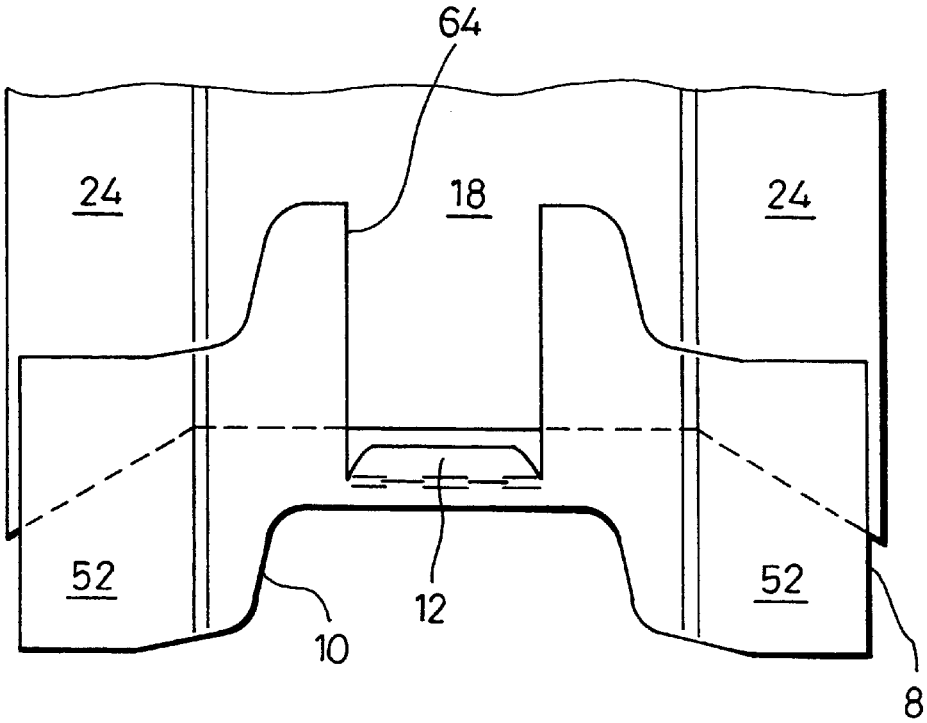
FIG. 30 is a view showing a modification the way of forming the lug.

The present invention is not limited to the embodiments described above, and various changes and modifications may be effected therein. According to the foregoing embodiments, for example, the lug 12 is raised from the slit in the lap region of the inner frame 8. Alternatively, however, the lug 12 may be designed to project into a rectangular notch 64 that is cut in that portion of the inner frame 8 which is lapped on the outer frame 6, as shown in FIG. 30. Also in this case, the lug 12 is raised on the front side of the body 2.

Figure 31:
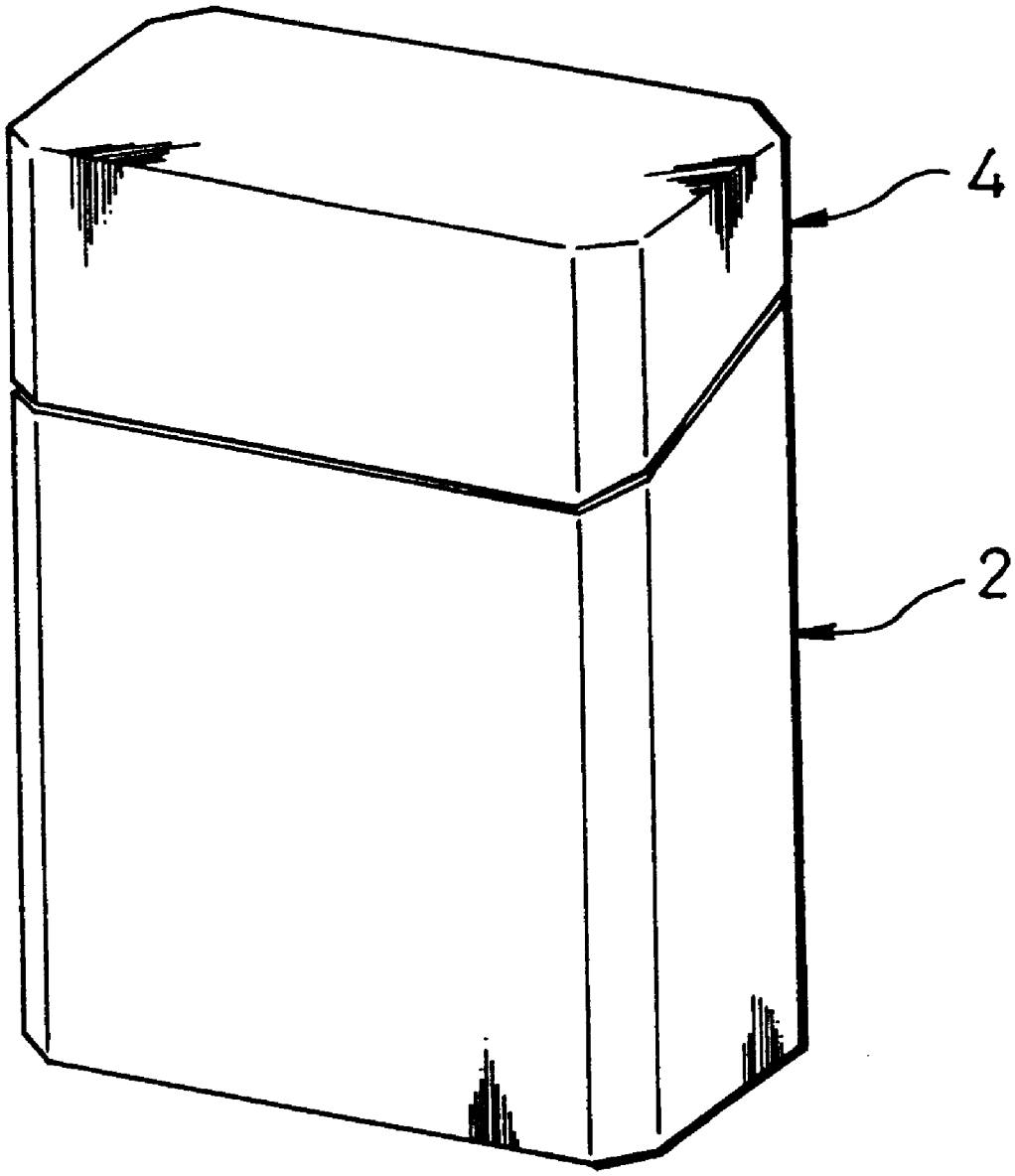
FIG. 31 is a perspective view showing a modification of the hinged-lid pack.
Figure 32:
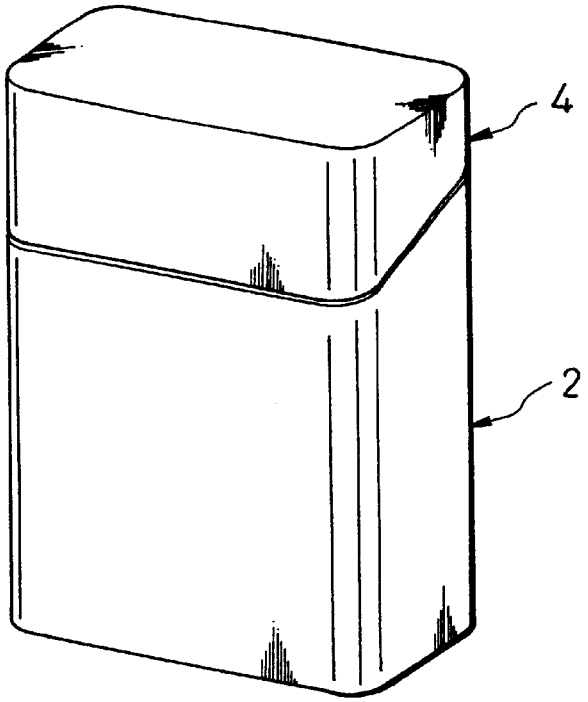
FIG. 32 is a perspective view showing another modification of the hinged-lid pack.
Figure 33:
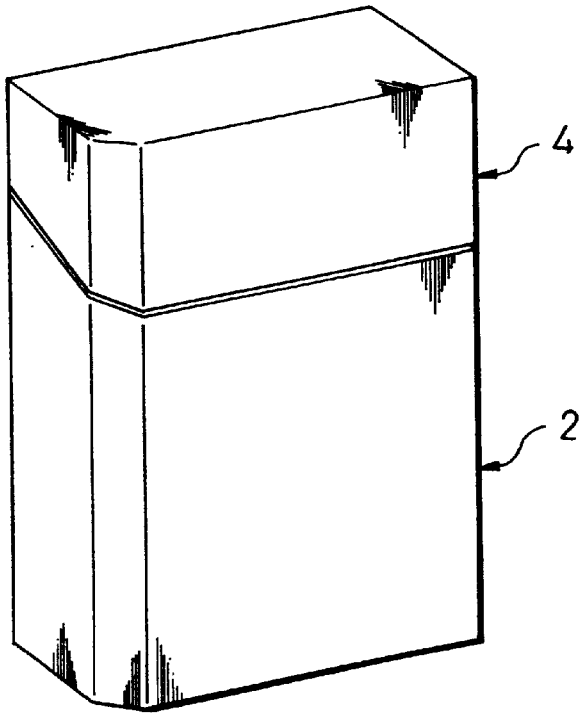
FIG. 33 is a perspective view showing still another modification of the hinged-lid pack.

Further, the shape of the hinged-lid pack to which the present invention can be applied is not limited to the shape of a rectangular parallelepiped. For example, the pack may be a box (octagonal box) that is formed by chamfering the longitudinal edges of a rectangular parallelepiped, as shown in FIG. 31, or a box (round-cornered box) that has arcuately chamfered edges, as shown in FIG. 32. Alternatively, moreover, the pack may be a box (bevel-edged box) only one end of which is chamfered, as shown in FIG. 33.

Furthermore, the outer and inner frames 6 and 8 may be formed integrally with each other. The inner frame 8 may be provided with a pair of lid locks on its left- and right-hand side walls, individually.

The lugs 12 according to the third and fourth embodiments may be ones that extend integrally from the bottom edge of the notch 10 of the inner frame 8 and are turned.

In the blanks 16 and 50 shown in FIG. 16, the respective shapes of the slits $C_0$ and C may be changed into any other suitable shapes, such as the shapes of a trapezoid, semiellipse, etc.

What is claimed is:

1. A hinged-lid pack comprising:

a box-shaped body opening at a top end thereof and having a rear opening edge;

a box-shaped lid hingedly connected to the rear opening edge of said body and opening at a bottom end thereof, said lid including a front wall adapted to close the opening of said body and cover an upper region of a front wall of said body from outside when said lid is put on the top end portion of said body;

a lug formed by part of the front wall of said body and raisable from said upper region of the front wall of the body toward said top end of the body, said lug having a base continuous integrally with the upper region of the front wall of the body and bent at a location lower than the top end of the body so as to project frontward from the front wall of the body;

an inner front flap located inside said lid, said inner front lap being connected integrally to the front wall of the lid and turned in toward an inner surface of the front wall of the lid so that a boundary between the front wall and the inner front wall and the inner front flap defines a front lower edge of the lid;

an opening formed by cutting a central portion of said inner front flap, said opening being tapered toward a ceiling of said lid and capable of receiving a distal end of said lug when said lid is in a shut state; and an engaging portion formed in said lid at a location between the opening in said inner front flap and the front lower edge of said lid, the engaging portion being adapted to adjoin the distal end of the lug when said lid is being shut down and to allow the distal end of the lug to be inserted temporarily through the opening into a gap between the engaging portion and the front wall of said lid when said lid in the shut state is rocked in an opening direction.

2. The hinged-lid pack according to claim 1, wherein the opening has a shape of a polygon.

3. The hinged-lid pack according to claim 1, wherein the opening has a shape of a pentagon formed by cutting off both base-angle portions of an isosceles triangle having a base extending along the engaging portion.

4. The hinged-lid pack according to claim 1, wherein a length of the base of the opening is longer than a minimum width of the lug and shorter than a maximum width of the lug.

5. The hinged-lid pack according to claim 1, further comprising a push portion provided in said lid and capable of pushing a part of said lid inward, said push portion including a substantially U-shaped slit formed in the front wall of said lid and a push piece surrounded by the slit and capable of being pushed in separately from and relatively to the front wall, a push of the push piece preventing the distal end of the lug from being inserted into the gap between the engaging portion and said lid when said lid in the shut state is rocked in the opening direction.

6. The hinged-lid pack according to claim 1, wherein said distal end of said lug when said lid is in said shut state fails to be inserted into said gap between said engaging portion and the front wall of said lid.

7. The hinged-lid pack according to claim 1, wherein an inner frame portion of said upper region is bent inward during said shut state by way of a discontinuity formed in said upper region.

8. The hinged-lid pack according to claim 1, wherein said engaging portion fails to contact said lug in said shut state.

9. The hinged-lid pack according to claim 1, wherein said lug when said lid is in said shut state fails to interlock with said engaging portion.

10. A hinged-lid pack according to claim 1, wherein said lug is defined by a slit and a crease formed in said upper region of the front wall of the body, and said crease is placed at a predetermined distance from said top end of the body.

* * * * *